US009212481B2

(12) United States Patent
Stramandinoli

(10) Patent No.: US 9,212,481 B2
(45) Date of Patent: Dec. 15, 2015

(54) CURTAIN-WALL SYSTEM FOR BUILDINGS

(71) Applicant: TIP TOP FENSTER S.r.l., fraz. Maranza-Rio di Pusteria (Bolzano) (IT)

(72) Inventor: Giovanni Stramandinoli, Beinasco (IT)

(73) Assignee: TIP TOP FENSTER S.R.L., fraz. Maranza-Rio di Pusteria (Bolzano) (IT)

( * ) Notice: Subject to any disclaimer, the term of this patent is extended or adjusted under 35 U.S.C. 154(b) by 0 days.

(21) Appl. No.: 14/247,506

(22) Filed: Apr. 8, 2014

(65) Prior Publication Data

US 2015/0284950 A1 Oct. 8, 2015

(51) Int. Cl.
*E04H 1/00* (2006.01)
*E04B 2/96* (2006.01)

(52) U.S. Cl.
CPC ..... *E04B 2/965* (2013.01)

(58) Field of Classification Search
CPC ..... E04B 2/965; E04B 2/88; E04B 2/90; E04B 2/92; E04B 2/96; E04B 2/962; E04B 2/967
USPC ..... 52/235
See application file for complete search history.

(56) References Cited

U.S. PATENT DOCUMENTS

| | | | | |
|---|---|---|---|---|
| 5,105,593 | A * | 4/1992 | Kaminaga et al. | 52/235 |
| 8,833,017 | B1 * | 9/2014 | Huang | 52/235 |
| 2008/0295425 | A1 * | 12/2008 | Farag | 52/235 |

* cited by examiner

*Primary Examiner* — Mark Wendell
(74) *Attorney, Agent, or Firm* — Nixon & Vanderhye P.C.

(57) ABSTRACT

A curtain-wall system for a building comprises a plurality of prefabricated cells (2), wherein each cell (2) includes:

a structural frame (10) with at least two uprights (11) and two end cross members (12), coupled together to form a perimetral structure that delimits an opening (V);

one or more infill elements (14-16) associated to the structural frame (10) at a front thereof, for closing the opening (V) delimited by the perimetral structure; and interface sectional elements (20, 21; 70-72) for coupling the one or more infill elements (14-16) to the front of the structural frame (10).

The uprights (11) and the cross members (12) of the structural frame (10) are uprights and cross members made of wood, the wooden uprights (11) having at least one first longitudinal groove (22) on a corresponding outer face, and the wooden cross members (12) having at least one second longitudinal groove (23) on a corresponding outer face.

Between the first grooves (22) of adjacent wooden uprights (11) of two cells (2) set aligned with one another in a horizontal direction there can be housed a first weatherstrip (45) and in the second groove (23) of a wooden cross member (12) of each cell (2) there can at least partially be housed a second weatherstrip (46).

20 Claims, 27 Drawing Sheets

44
43
43a
40
20
16'
45
16
22
45
2
22
11
21
48
48
G
46
19
46
17
48
48
G
11
21
41
2
22
45
14
45
22
14'
42a
42
20

CURTAIN-WALL SYSTEM FOR BUILDINGS

FIELD OF THE INVENTION

The present invention relates to curtain walls for buildings and has been developed with particular reference to the prefabricated cells used for creating such curtain walls.

BACKGROUND ART

In the current state of the art, it is known to provide curtain walls or structural walls using purposely provided panel elements, known as "cells", which are pre-assembled at the production site and subsequently mounted on the building site.

The above cells are associated individually to a load-bearing structure of the building, typically represented by its floors, independently of one another, so as to enable the necessary settling of the curtain wall due to thermal expansion and/or to occasional seismic movements, without thereby bringing about failure of the parts that make up the various cells.

The cells have a metal structural frame, delimiting an opening that can be closed via infill elements. The frame is usually made of aluminum, and the infill elements may be of the transparent type or else the blind type, and may be fixed or else openable, according to the requirements.

The cells according to the known art are on average satisfactory, but it would be desirable to improve their performance in terms of thermal and acoustic insulation, as well as of fire resistance.

SUMMARY OF THE INVENTION

In its general terms, the object of the present invention is to provide a prefabricated cell for curtain walls of buildings that will be simple and economically advantageous to produce, aesthetically attractive, and distinguished by improved characteristics of thermal and acoustic insulation, as well as increased fire resistance.

The above objects are achieved according to the present invention by a curtain-wall system for buildings and by corresponding prefabricated cells that present the characteristics indicated in the annexed claims.

BRIEF DESCRIPTION OF THE DRAWINGS

Further objects, characteristics, and advantages of the invention will emerge clearly from the ensuing detailed description, with reference to the annexed plates of drawings, which are provided by way of explanatory and non-limiting example and in which.

DESCRIPTION OF EMBODIMENTS OF THE INVENTION

Figure 1:
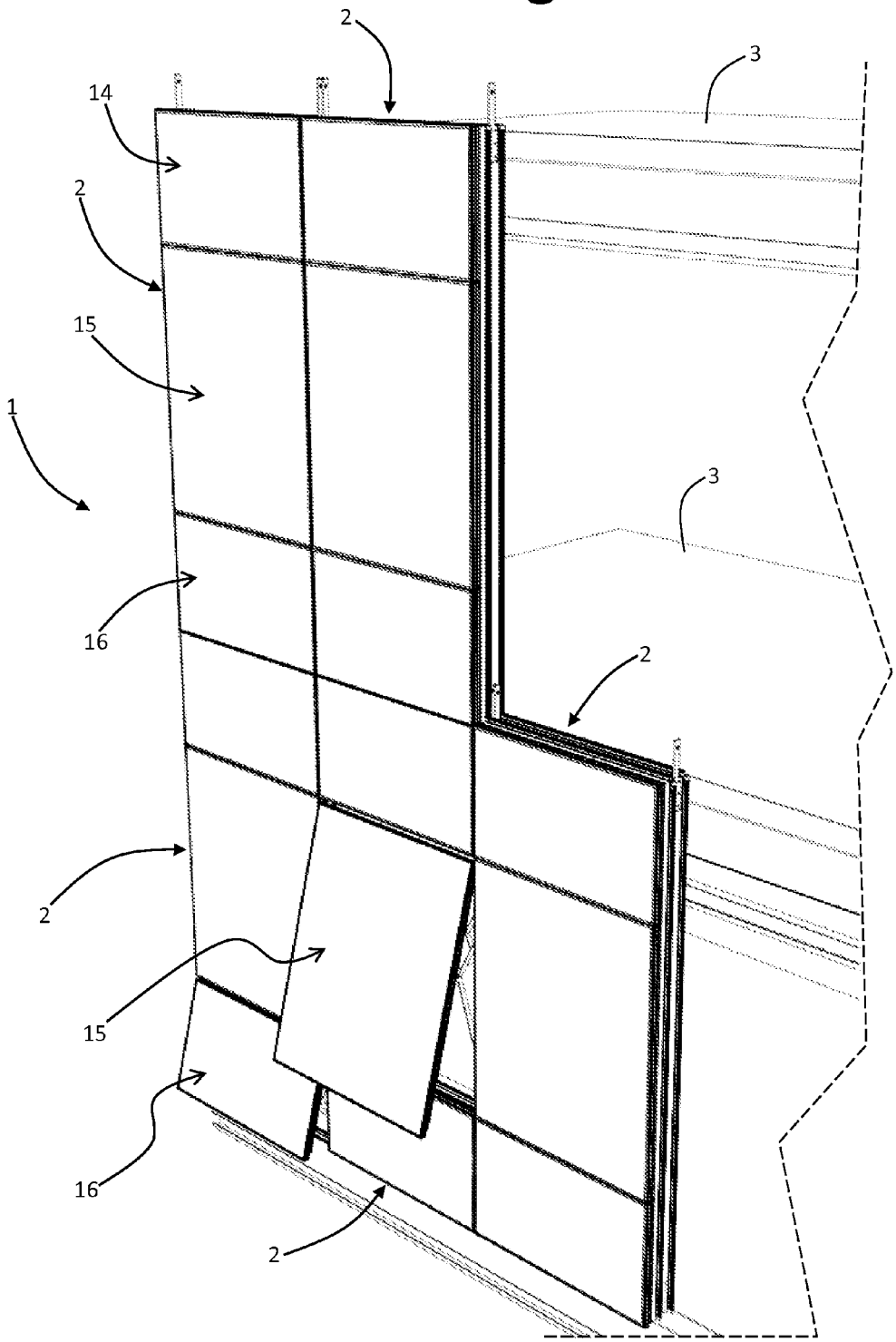
FIG. 1 is a schematic perspective view of a portion of a curtain wall provided according to the invention.

Represented partially and schematically in FIG. 1 is a curtain wall or structural wall obtained with the system according to the invention.

The curtain wall 1 comprises a plurality of prefabricated cells 2, which are supported by the load-bearing structure of a building, here represented by respective floors 3. The cells 2 have a substantially quadrangular conformation, preferably rectangular as in the example illustrated, but this shape is not to be understood as imperative. The prefabricated cells 2 are preferably pre-arranged for being associated to the floors 3 of the building in positions set aligned or adjacent to one another both in the horizontal direction and in the vertical direction, substantially according to one and the same plane of lay. On the other hand, not excluded from the scope of the invention are solutions in which the cells are set aligned with one another only in a horizontal direction.

Figure 3:
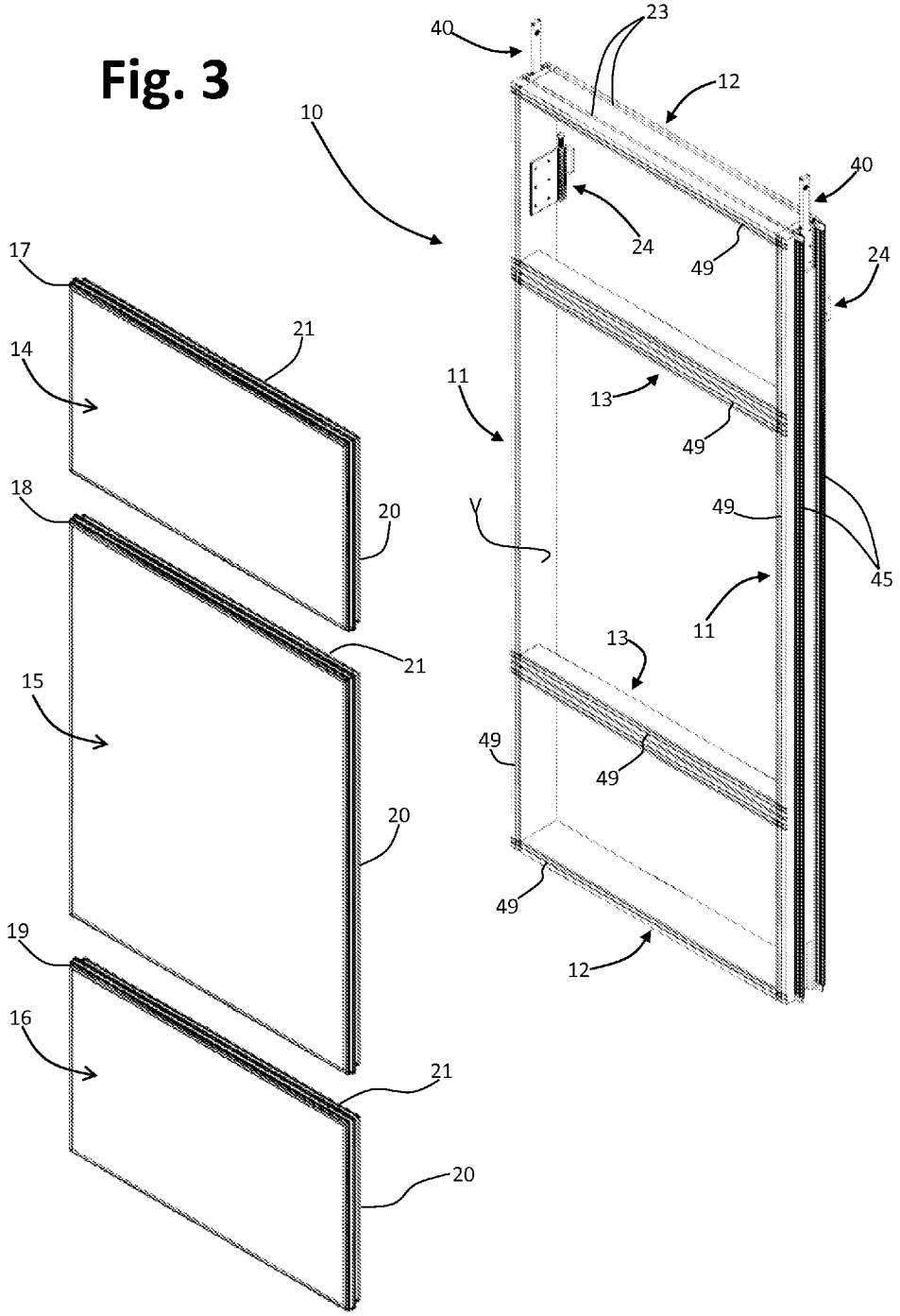
FIG. 3 is a partially exploded perspective view of a prefabricated cell of a system according to the invention.
Figure 4:
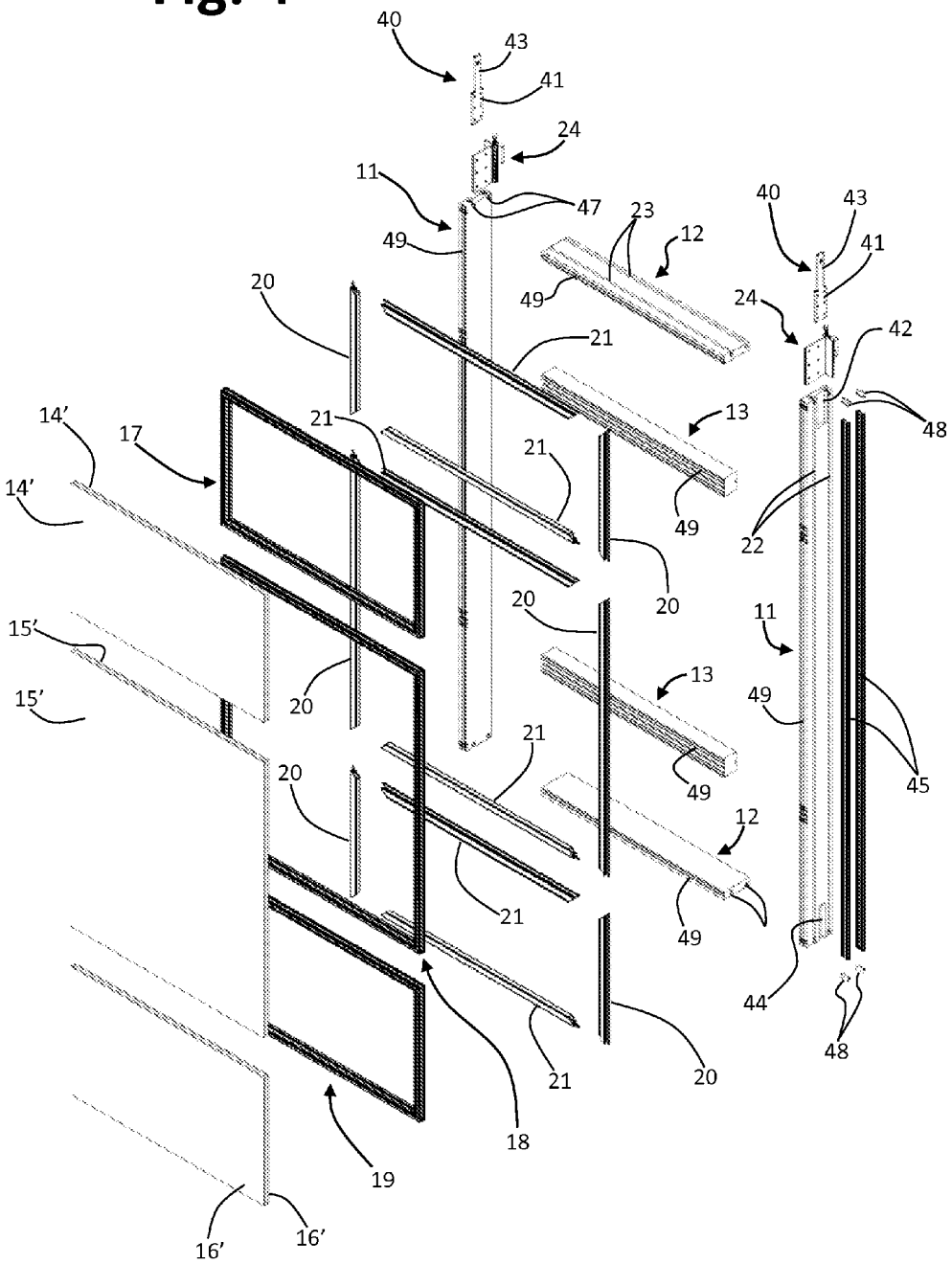
FIG. 4 is an exploded view of the cell of FIG. 3.

FIGS. 3 and 4 represent a single cell 2, in a partially exploded view and in a totally exploded view, respectively. Each cell 2 comprises a structural frame, designated as a whole by 10, which comprises at least two uprights 11 and two end cross members 12, coupled so as to form a perimetral structure that delimits a compartment or opening V. In the example, the structural frame 10 also comprises two intermediate cross members, designated by 13.

The cell 2 further comprises one or more outer infill elements, associated to the structural frame 10 at the front of the latter so as to close the compartment V. In the example, the cell 2 comprises three infill elements, of different dimensions, designated by 14, 15 and 16. The elements 14 and 16 at the two ends of the cell have smaller dimensions than the element 15, being designed to close the portions of the compartment V that extend substantially between an end cross member 12 and an intermediate cross member 13. The infill element 15 is, instead, designed to close the central portion of the compartment V, comprised between the two intermediate cross members 13. Obviously, configurations with a different number of infill elements are possible, for example just one infill element or two infill elements.

Figure 2:
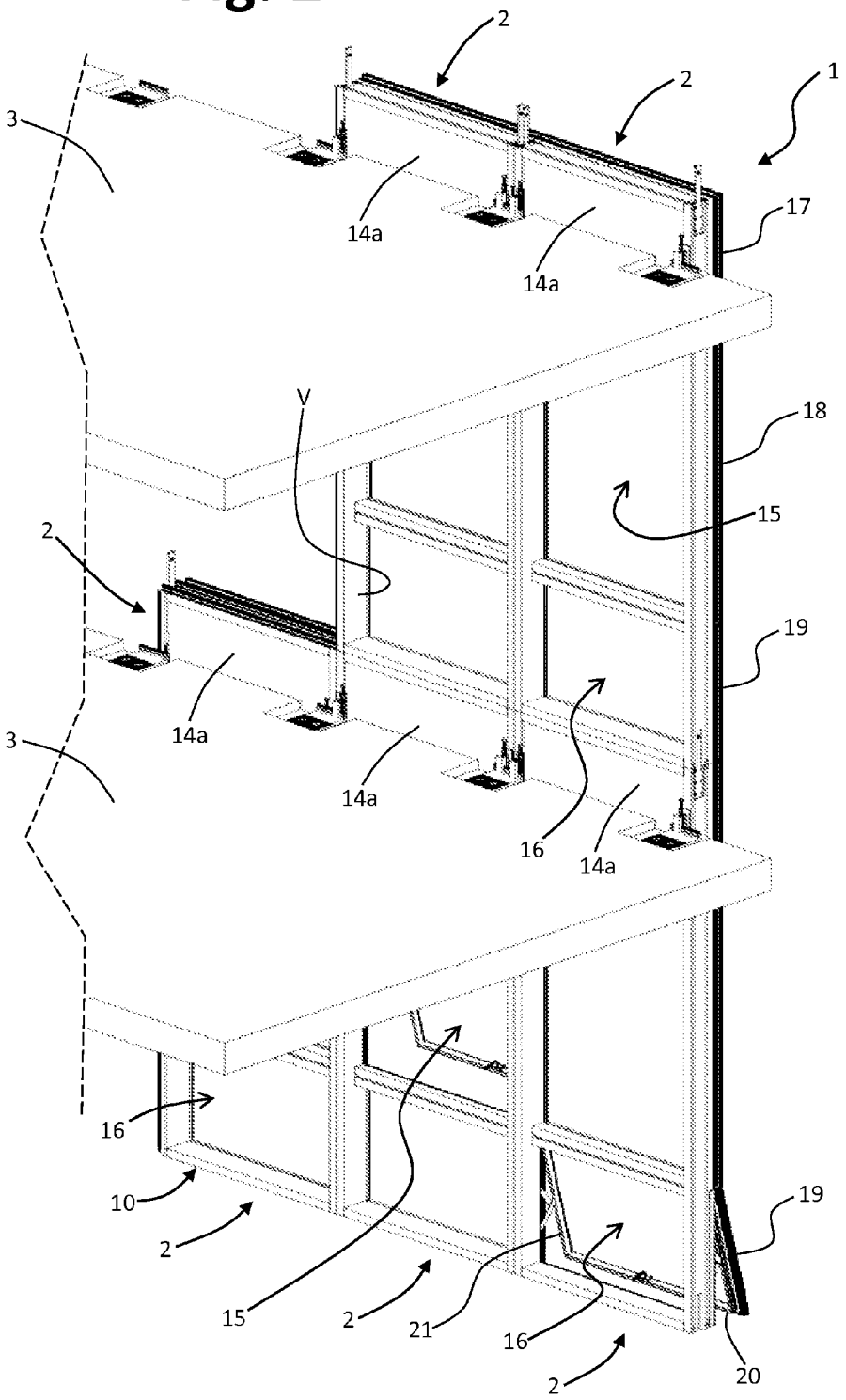
FIG. 2 is a second partial and schematic perspective view of a portion of a curtain wall according to the invention, from the inside of a building.

The infill elements 14-16 may be fixed elements or else elements that can be opened and closed like a window. In the example of FIGS. 1 and 2, some of the elements 15 and 16 are in fact elements that can be opened and closed like a hung window. As explained previously, the infill elements 14-16 may comprise transparent or else opaque elements, according to the need. In the sequel of the present description, it is assumed that the elements 14-16 are as a whole transparent and comprise at least two panes of glass, designated by 14', 15' and 16' in FIG. 4.

In one embodiment, the cell 2 may also comprise at least one inner infill element, for example in its portion close to a floor 3 of the building: in the example illustrated in FIG. 2, designated by 14*a* are some further infill elements, for example opaque panels, which close the compartment V on the inside of the cell 2, in an area corresponding to a respective outer infill element 14.

Designated, instead, by 17, 18, and 19 are perimetral weatherstrips forming part of the infill elements, preferably made of a resilient material, such as silicone. As will be seen hereinafter, the weatherstrips 17-19 are mounted in such a way that a respective sealing part is in a peripheral position with respect to the panes of glass 14'-16', i.e., substantially at their edges.

Each cell 2 comprises a plurality of interface sectional elements used for coupling the infill elements 14-16 to the front of the frame 10. The aforesaid sectional elements are preferentially made of metal, in particular aluminum, but use of other materials, such as plastic or composite materials, is not ruled out. These sectional elements, represented in exploded view in FIG. 4, comprise upright or vertical sectional elements, designated by 20, and transverse or horizontal sectional elements, designated by 21. In what follows, it is assumed that the sectional elements 20 and 21 are metal sectional elements. A pair of sectional elements 20 and a pair of sectional elements 21 are assembled together to form a sort of interface frame, substantially having a shape similar to that of a corresponding infill element 14, 15, or 16, which is set between said infill element and the front of the structural frame 10.

Once again clearly visible in FIG. 4 are the uprights 11 and the cross members 12, 13 of the structural frame. According to a characteristic of the invention, the uprights and the cross members of the frame 10 are uprights and cross members made of wood. In a preferred embodiment, the wood used for making the uprights 11 and cross members 12, 13 is laminated wood, which guarantees good mechanical characteristics, good characteristics of thermal and acoustic insulation, and a good fire resistance. Wood in general, and glued-laminated wood in particular, then presents the major advantage of being very attractive.

Once again according to the invention, the uprights 11 have at least one corresponding longitudinal groove on the corresponding outer face, and the end cross members 12 have at least one corresponding longitudinal groove on the corresponding outer face. In the specific example represented, which regards a preferred embodiment of the invention, both the uprights 11 and the cross members 12 have at least two such parallel grooves between them, some of which are designated in FIG. 4 by 22 and 23, respectively. As will emerge more clearly hereinafter, each groove 22 and each groove 23 is designed to receive a weatherstrip.

The uprights 11 have, in a respective upper end region, an engagement device 24, pre-arranged for coupling with a corresponding suspension member fixed to a floor 3 of the building. An engagement device 24 and a corresponding suspension member 25 are visible in FIG. 5 in a condition of engagement, whereas in FIG. 6 they appear in exploded view. As will be seen, in a preferred embodiment at least one between the engagement device 24 and the suspension member 25 has at least one adjustment element, which can be operated for height adjustment of a position of the cell 2 relative to a respective floor 3 of the building.

The suspension member 25 basically consists of a plate body, made of metal material. The front edge of said plate body is bent substantially orthogonally upwards so as to define an engagement upright 25*a*, having preferably but not necessarily the top surface substantially semicircular. The plate member 25 is designed to be anchored to a floor 3 at a peripheral edge thereof, preferably with a front portion of the member 25—including the engagement upright 25*a*—that projects at the front with respect to the floor, as may be seen for example in FIGS. 7 and 8. In the preferred embodiment, anchorage of the suspension member 25 is obtained by metal anchor-bolt elements 26, for example embedded in the cement constituting the floor, to which the plate member 25 is fixed via nuts 27 and washers 27*a* or the like.

The engagement device 24 is preferentially made in a number of parts. In the example shown (see in particular FIG. 6), the engagement device 24 comprises a base element made of metal 30, including two mutually orthogonal walls 31 and 32, set substantially to form an L. In the area of union between the two orthogonal walls 31 and 32, the metal element 30 further comprises a curved wall, with a development of less than 360°, to define a sort of longitudinally extended eyelet 33, defining a longitudinal seat 33*a* that is at least in part threaded.

Screwed into the above threaded seat 33*a* is a screw 34, which constitutes the aforesaid adjustment element. The member 24 further comprises an engagement element 35 having a substantially C-shaped or U-shaped section, including a first wall 36 that is to be engaged from beneath in the seat 33*a*, through the gap existing between the free end of the curved wall 33 and the wall 32. Departing orthogonally from the wall 36 is a wall 37 for connection to a further orthogonal wall 38, which is generally parallel to the wall 36. Defined in the connection wall 37 is a lower recess or seat 39, in which the upright engagement part 25*a* of the suspension member 25 is to be engaged. Preferably, but not necessarily, the walls 36 and 37 have a respective portion that extends further down than the wall 38 and than a remaining portion of the wall 37. In the assembled condition, as may be seen for example in FIG. 5, the wall 36 of the engagement element 35 is inserted from beneath in the seat 33*a* so as that it can slide therein, through the aforesaid gap, until it comes to bear upon the bottom end of the screw 34. On the other side, engaged in the seat 39 of the element 35 is the engagement upright 25*a* of the plate element 25, with the bottom end of the wall 38 and of part of the wall 37 that preferably come to bear upon the upper surface of the plate member 25. As may be appreciated, the engagement device 24 is engaged to the suspension member 25 so as to support from above the respective upright 11 of the structural frame 10 of a cell 2. As has been seen, both of the uprights 11 of the frame 10 are provided with an engagement device 24 designed to engage to a respective plate 25. The coupling thus provided renders possible adjustment of the position in the axial direction of the element 30 of the engagement device 24. The presence of the screw 34 enables for this purpose a fine height-adjustment of the position of the cell 2 to be carried out: as may be appreciated, in fact, by screwing or unscrewing the screw 34 it is possible to vary the relative position between the element 30 and the engagement element 35 and thereby vary the position of the cell 2 relative to the plate 25.

The component 30 of the engagement device 24 is designed to be fixed with its wall 31, which is provided with holes, in a position corresponding to the inner face of the respective upright 11 with a series of screws that engage directly in the wood that constitutes the upright (some of these screws, designated by 30*a*, are visible in FIG. 13); the wall 32 of the element 30 is instead adjacent to the rear face of the upright 11.

To return to FIG. 4, the uprights 11 have, at a first end, here the upper end, a respective coupling member 40. The member 40 is substantially a plate element made of metal material, having a fixing portion 41 provided with holes that is designed to be housed in a respective seat 42 defined in the upper end region of the outer face of the upright 11. The member 40 then presents a top engagement portion 43, which is preferably provided with a through hole 43*a* (see FIG. 12) and has a smaller width than the fixing portion 41. In the assembled condition, the engagement portion projects axially upwards with respect to the frame 10, i.e., beyond the upper cross member 12. At the opposite end, the outer face of each upright 11 has a respective receiving seat 44 having a shape substantially corresponding to that of the engagement portion 43 of the coupling member 42. As may be appreciated, in this way the portions 43 of the members 40 at the first end of the uprights 11 of a first cell 2 can be received in the seats 44 at the second ends of the uprights 11 of a second cell that is set aligned in a vertical direction on top of the first cell. This concept is exemplified in FIG. 12.

Figure 6:
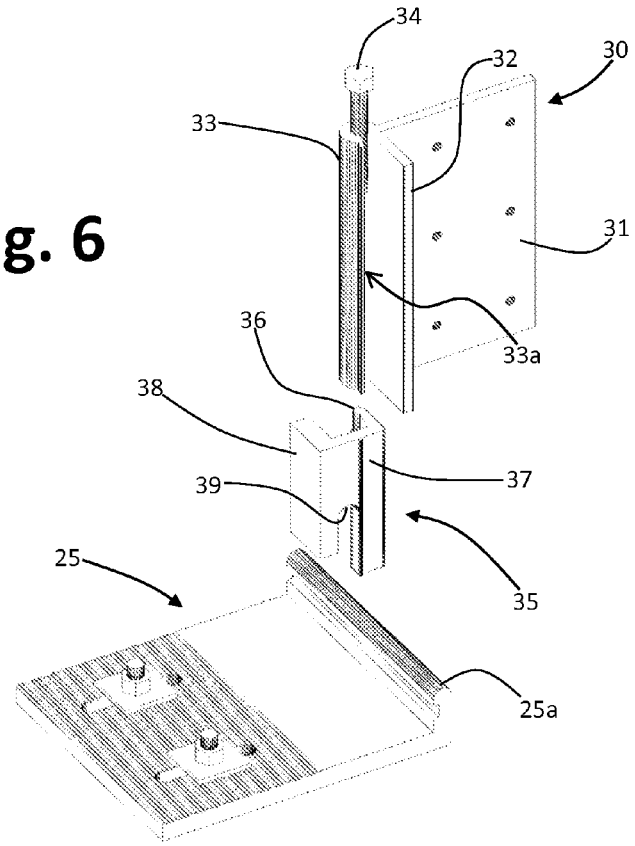
Figure 7:
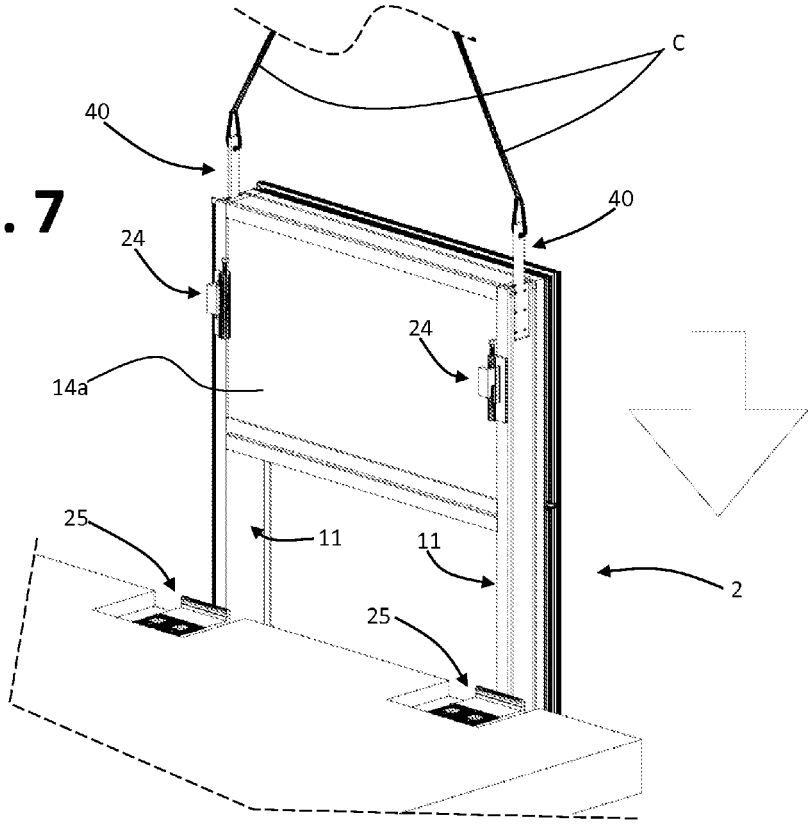
FIGS. 7 and 8 are partial and schematic perspective views aimed at exemplifying the modalities of engagement of a cell of the system according to the invention to a corresponding floor.
Figure 8:
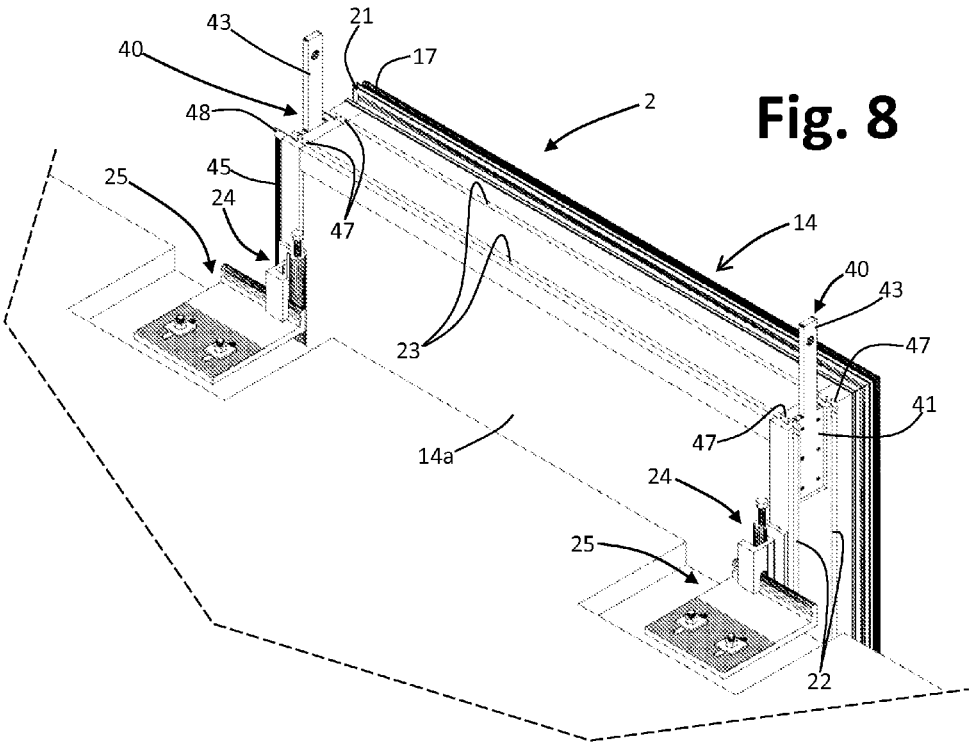

Represented schematically in FIGS. 7 and 8 is the step of engagement of a cell 2 to a corresponding floor 3 of the building. To the floor 3 there are previously fixed the suspension plates 25, and the cell 2 is lowered from above, for example using a cable C engaged in the holes 43*a* of the coupling members 40 of the cell 2. Lowering of the cell is performed so as to bring about the engagement described above between the engagement devices 24 and the plates 25, the condition of coupling being visible, for example, in FIG. 8. As explained previously, if need be, the exact positioning in height and the horizontal alignment of the cell 2 may be obtained by acting on the adjustment screws 34 represented in FIGS. 5-6. The system may also comprise elements for adjusting the horizontal position of the cells relative to the front of the floors. In the represented example, these adjusting elements comprise horizontal slots of the plates 25 in which the anchor-bolt elements 26 are inserted.

Figure 12:
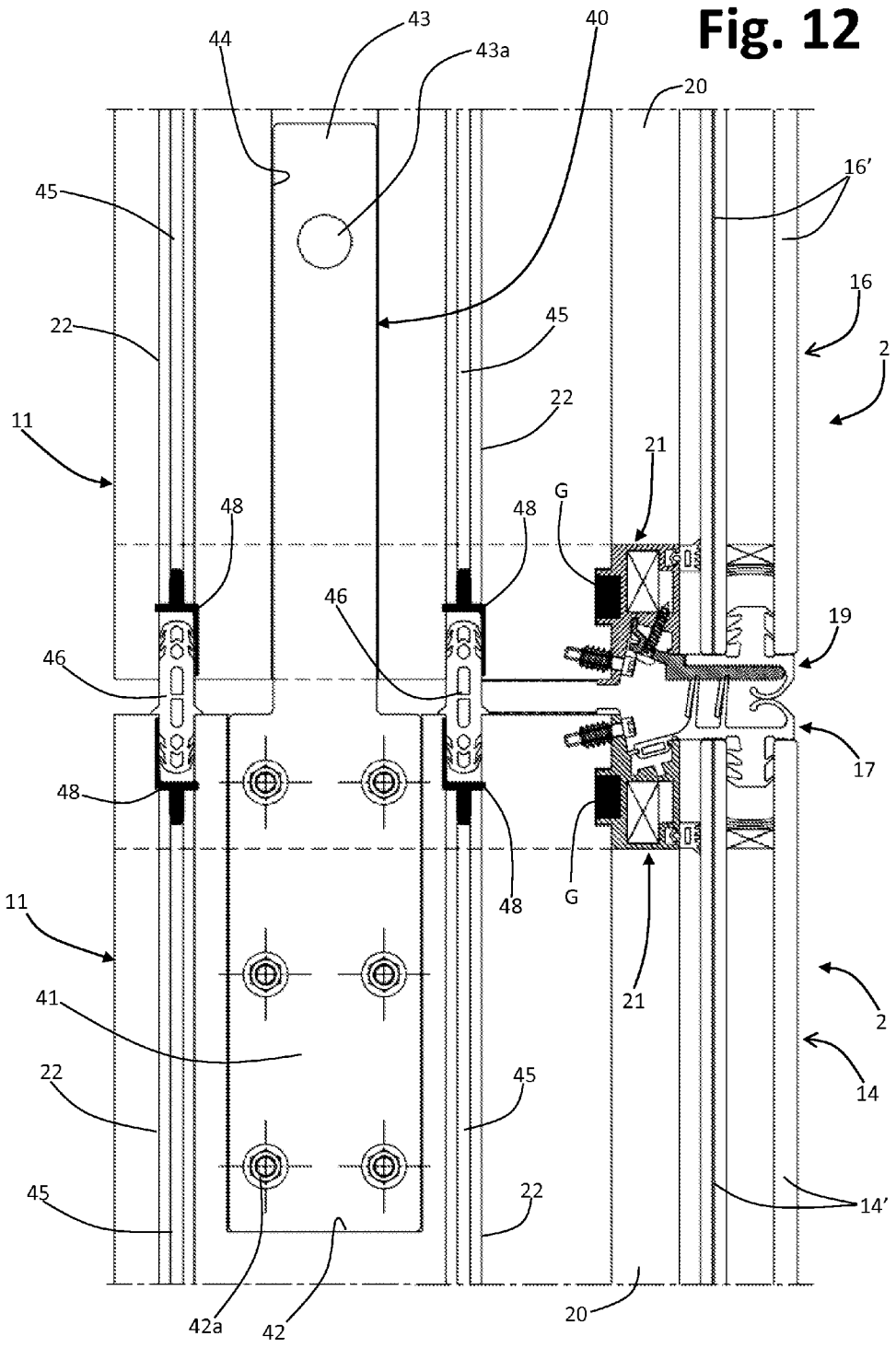
FIGS. 12-17 are schematic cross sections according to the lines XII-XII, XIII-XIII, XIV-XIV, XV-XV, XVI-XVI e XVII-XVII of FIG. 11.

With the aforesaid lowering of the cell, also engagement in the seats 44 of the lower part of the uprights 11 is obtained, with the corresponding portions 43 of the members 40 projecting from an underlying cell 2, i.e., a cell engaged to the floor that is located underneath the floor considered; this condition of coupling may be seen, for example, in FIG. 12.

As has been said, the outer faces of the uprights 11 and of the end cross members 23 have respective pairs of first grooves 22 and second grooves 23, respectively, said grooves being designed to house respective weatherstrips. In the preferred embodiment, the distance between the grooves 22 and the distance between the grooves 23 is greater than a dimension of width of the coupling members 40, as is clearly visible, for example, from FIG. 8. Preferentially, moreover, the distance between the grooves 22 and the distance between the grooves 23 are the same as one another.

As will emerge clearly hereinafter, housed between grooves 22 of the adjacent uprights 11 of two cells 2 set aligned with one another in a horizontal direction is a first weatherstrip, whereas housed between grooves 23 of adjacent cross members 12 of two cells 2 set aligned with one another in a vertical direction is a second weatherstrip. Two of the aforesaid first weatherstrips, which extend vertically, are designated by 45, for example, in FIG. 4, and have substantially the same length as the uprights 11. Pairs of these weatherstrips 45 are visible in the assembled condition in FIGS. 3 and 9, from which it may also be noted how the engagement device 40 is set between the weatherstrips 45, and hence between the corresponding grooves of the upright 11 represented.

Figure 9:
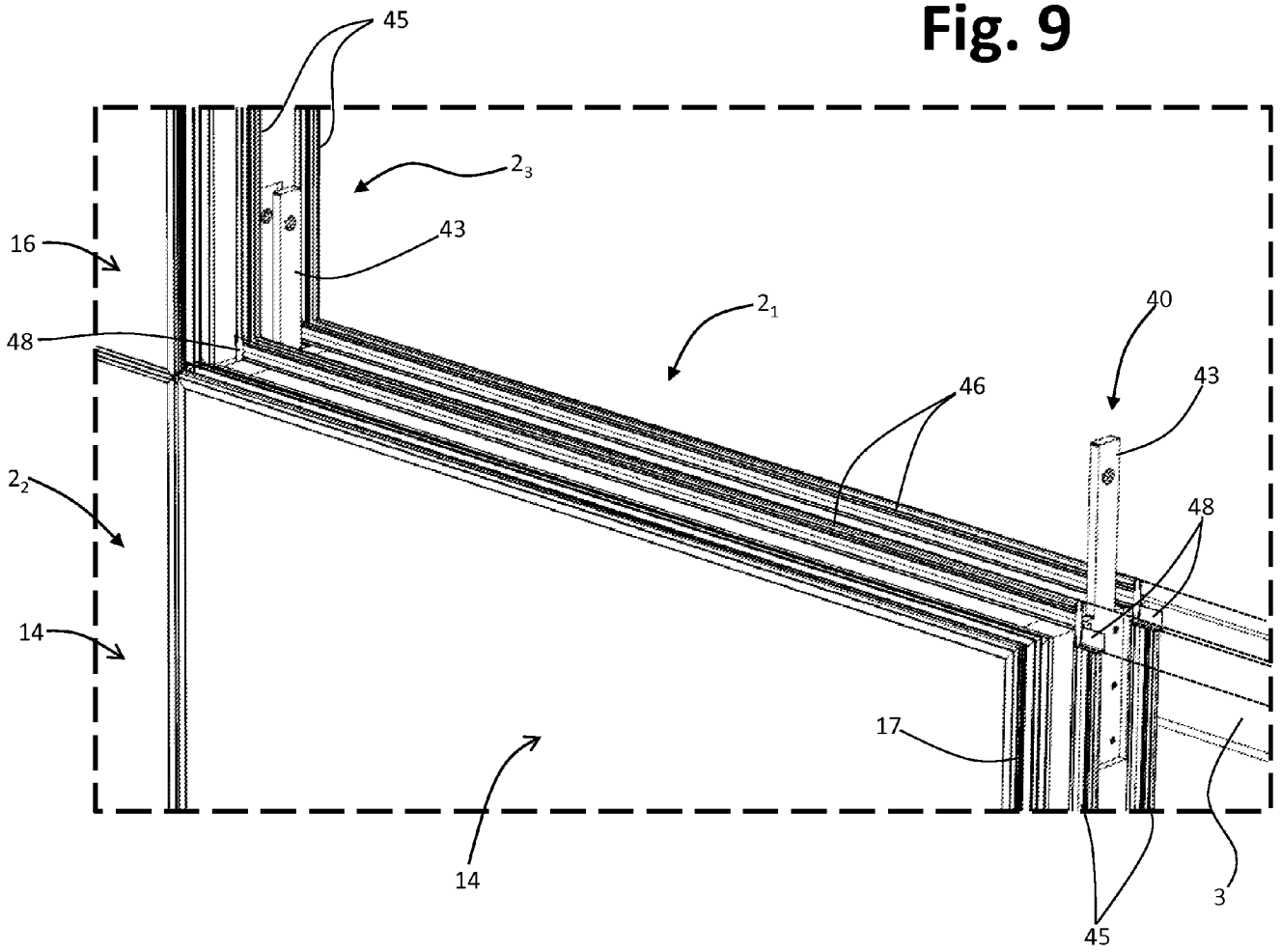
FIGS. 9 and 10 are schematic perspective views of a portion of a curtain wall according to the invention.
Figure 10:
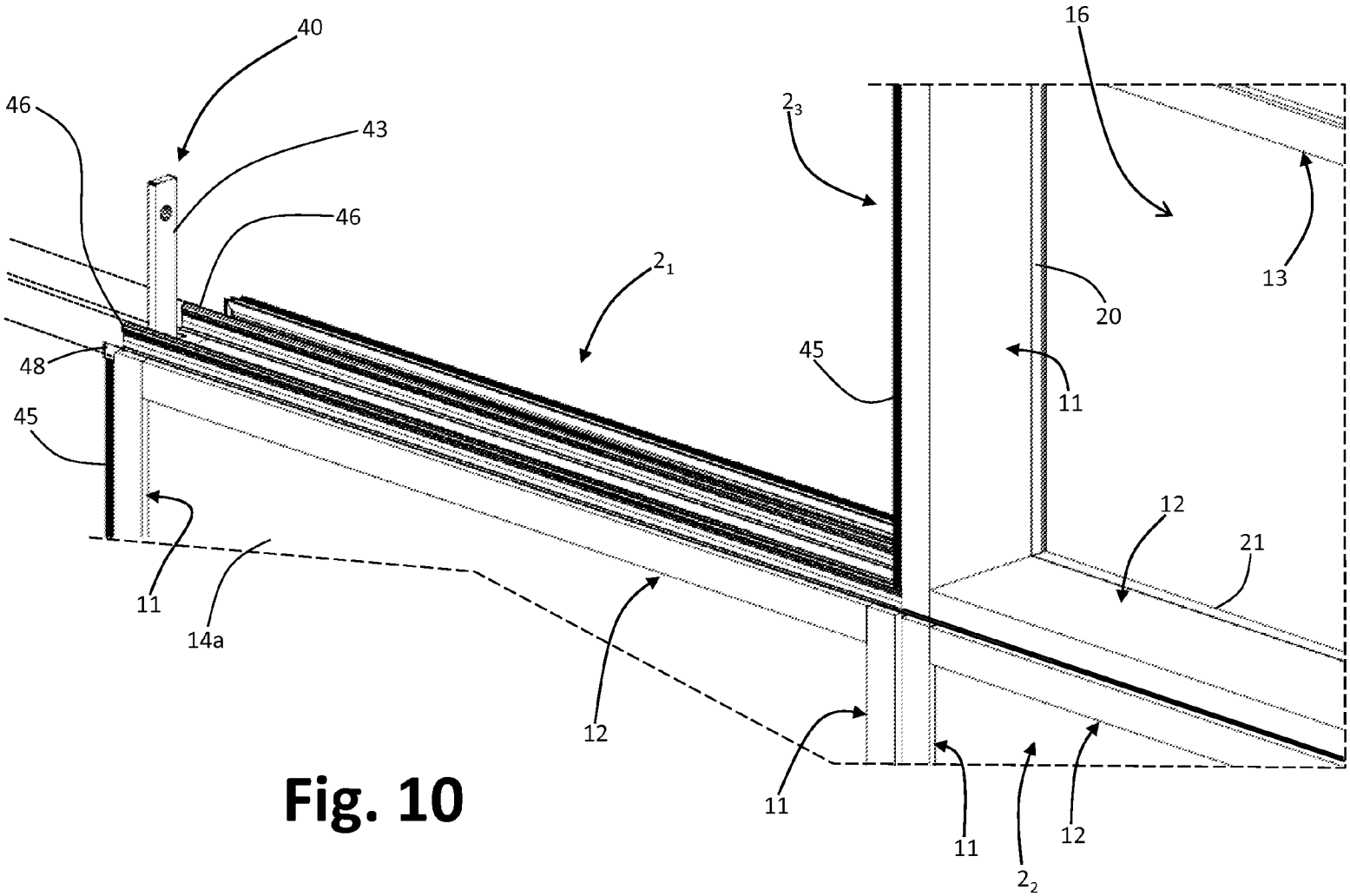

Also visible in FIGS. 9 and 10 are the aforesaid second weatherstrips, designated by 46, which extend horizontally in the respective grooves obtained on the outer surfaces of the end cross members 12. As may be evinced, in the case of two cells 2 set aligned with one another in a horizontal direction, the weatherstrips 45 are housed between the grooves 22 of the uprights 11 facing the two cells in question. In the case of two cells set aligned with one another in the direction of height, the weatherstrips 46 are housed between the grooves 23 of the adjacent end cross members of the two cells, i.e., the lower cross member 12 of one cell and the upper cross member 12 of the underlying cell.

According to a preferential characteristic of the invention, the horizontal weatherstrips 46 have a length greater than the length of the cross members 12, 13 of the structural frame 10 of a cell 2. In this way, the weatherstrips 46 extend also in the grooves 23 of the cross members 12 of two or more cells set aligned with one another in a horizontal direction (possibly all the cells of one and the same floor or storey of the building). This concept may be appreciated from the aforesaid FIGS. 9 and 10, where the weatherstrips 46 represented are engaged, not only in the corresponding grooves 23 of the upper cross member 12 of the cell designated by $\mathbf{2}_1$, but also in the homologous grooves present in the upper cross member 12 of the cell designated by $\mathbf{2}_2$ (as well as in the grooves 23 of the lower cross member 12 of the cell designated by $\mathbf{2}_3$).

The above characteristic is particularly advantageous for the purpose of guaranteeing the necessary seal between the cells set aligned with one another and simplifies construction of the curtain wall 1. It will be appreciated in fact that, after a series of cells 2 have been set aligned with one another in a horizontal direction so that they hang from one and the same floor 3, it is extremely convenient and advantageous to provide single weatherstrips 46 that equip all these cells aligned horizontally, or at least a plurality of them. In a subsequent step of creation of the curtain wall, on the above weatherstrips 46 the grooves 23 of the lower cross members 12 of the cells hanging from the overlying floor 3 will be engaged. It will be appreciated that, since the weatherstrips 45 and 46 have the same shape in cross-section, they can be obtained by cutting them, from one and the same roll, to the required length even directly on the building site.

It should be also again pointed out that the uprights 11 have, in their respective longitudinal end faces, at least one respective further groove that is axially aligned with a groove 23 of the end cross members 12 of the structural frame. Some of these further grooves are designated, for example, by 47 in FIGS. 4 and 10. As may be appreciated, in this way the weatherstrips 46 can extend also through said grooves 47.

As regards, instead, the vertical weatherstrips 45, as has been said these have substantially the same length as the uprights 11 of the frames 10. In a preferred embodiment, the weatherstrips 45 may be pre-assembled in the grooves 22 of one of the two uprights 11 of a cell (for example, the cell $2_2$ of FIGS. 9, 10) so that they can then also engage in the homologous grooves provided in the upright 11 of the adjacent cell (for example, the cell $2_1$ of FIGS. 9, 10).

Preferably, at the two longitudinal ends of the vertical weatherstrips 45 there are mounted in the corresponding grooves 22 interface elements, some of which are designated by 48, for example, in FIGS. 4, 8, 9 and 10. These elements 48 have the function of constituting an interface between the vertical weatherstrips 45 and the horizontal weatherstrips 46. Obviously, also the elements 48 are received in part in the grooves 22 of the upright of one cell and in part in the grooves 22 of an adjacent upright of a second cell aligned horizontally to the first. An example of positioning of some elements 48 is clearly visible also in FIGS. 8-9 and 12. The elements 48 are, for example, constituted by substantially L-shaped plastic sectional elements, i.e., with two mutually orthogonal walls, from one of which there preferentially projects a positioning appendage designed to be inserted in an axial cavity of the corresponding weatherstrip 45.

In a preferred embodiment of the invention, the uprights 11 and the cross members 12, 13 of the structural frame 10 have one or more front longitudinal grooves, for coupling of corresponding portions of a respective interface sectional element 20 or 21. The aforesaid front grooves are designated by 49, for example, in FIG. 4. The front face of the uprights 11 preferentially also has transverse front grooves (not shown) in positions homologous to the front grooves of the cross members 12, 13.

Figure 11:
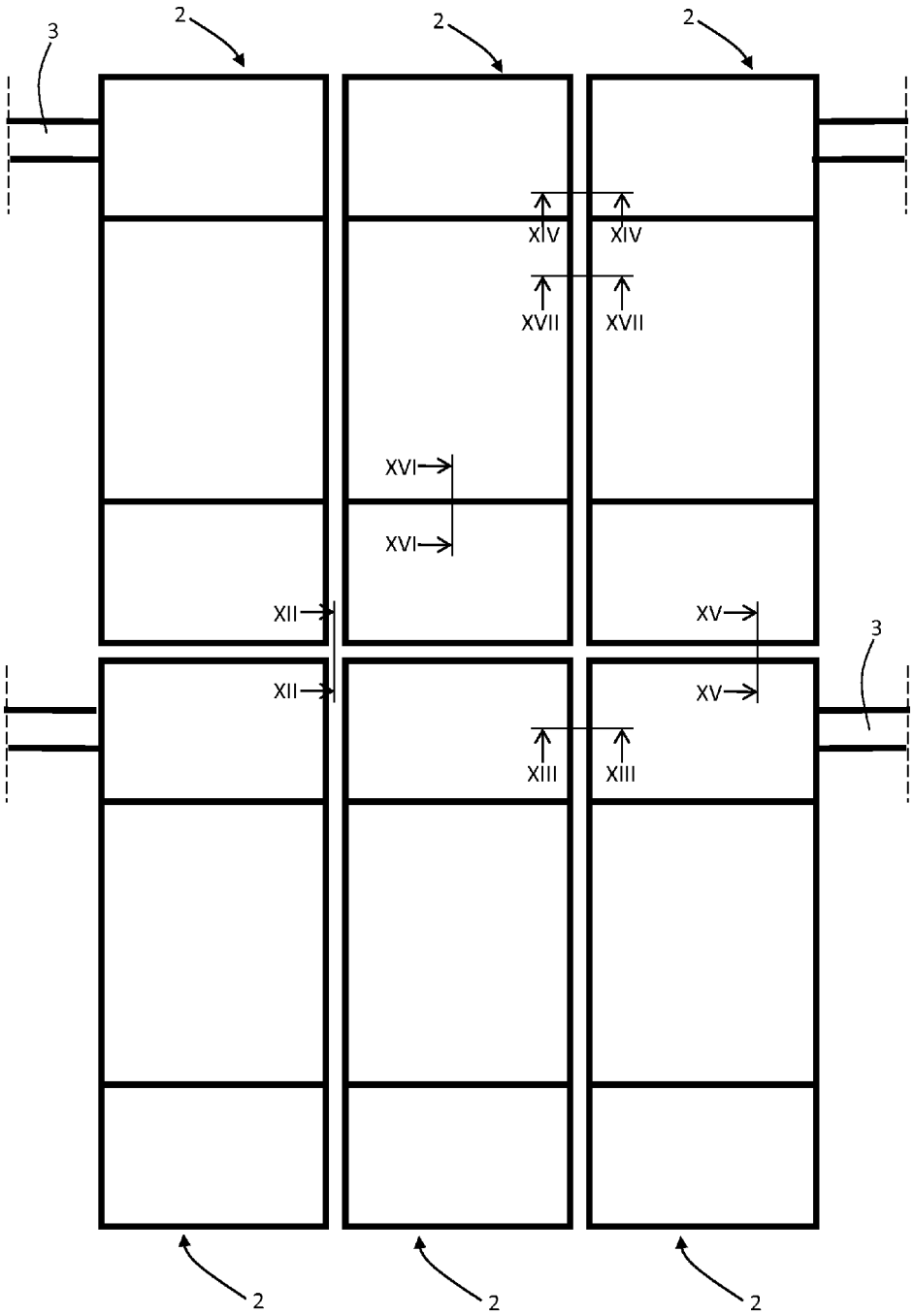
FIG. 11 is a schematic representation in front elevation of a portion of a curtain wall provided with the system according to the invention.

FIG. 11 is a schematic representation in front elevation of a portion of a curtain wall according to the invention, whereas FIGS. 12-17 illustrate schematically, via different cross sections, various details of the curtain wall formed using cells 2 described previously.

FIG. 12 shows the area of connection between two frames 10 set vertically aligned with one another, with the projecting portion 43 of the coupling member 40 at the upper end of an upright 11 that is engaged in the corresponding seat 44 defined at the lower end of the upright 11 of an overlying cell. Fixing of the portion 41 of the member 40 in the corresponding seat 42 is obtained with screws, one of which is designated by 42*a*.

Figure 5:
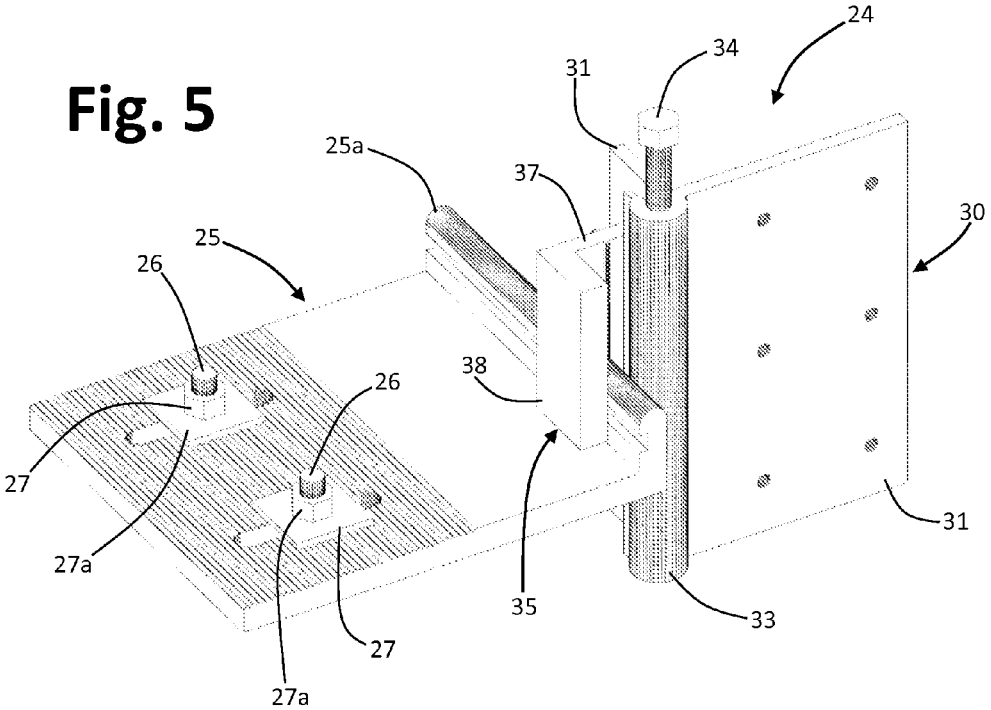
FIGS. 5 and 6 are a schematic perspective view and an exploded view, respectively, of a system for engagement of prefabricated cells according to the invention.
Figure 13:
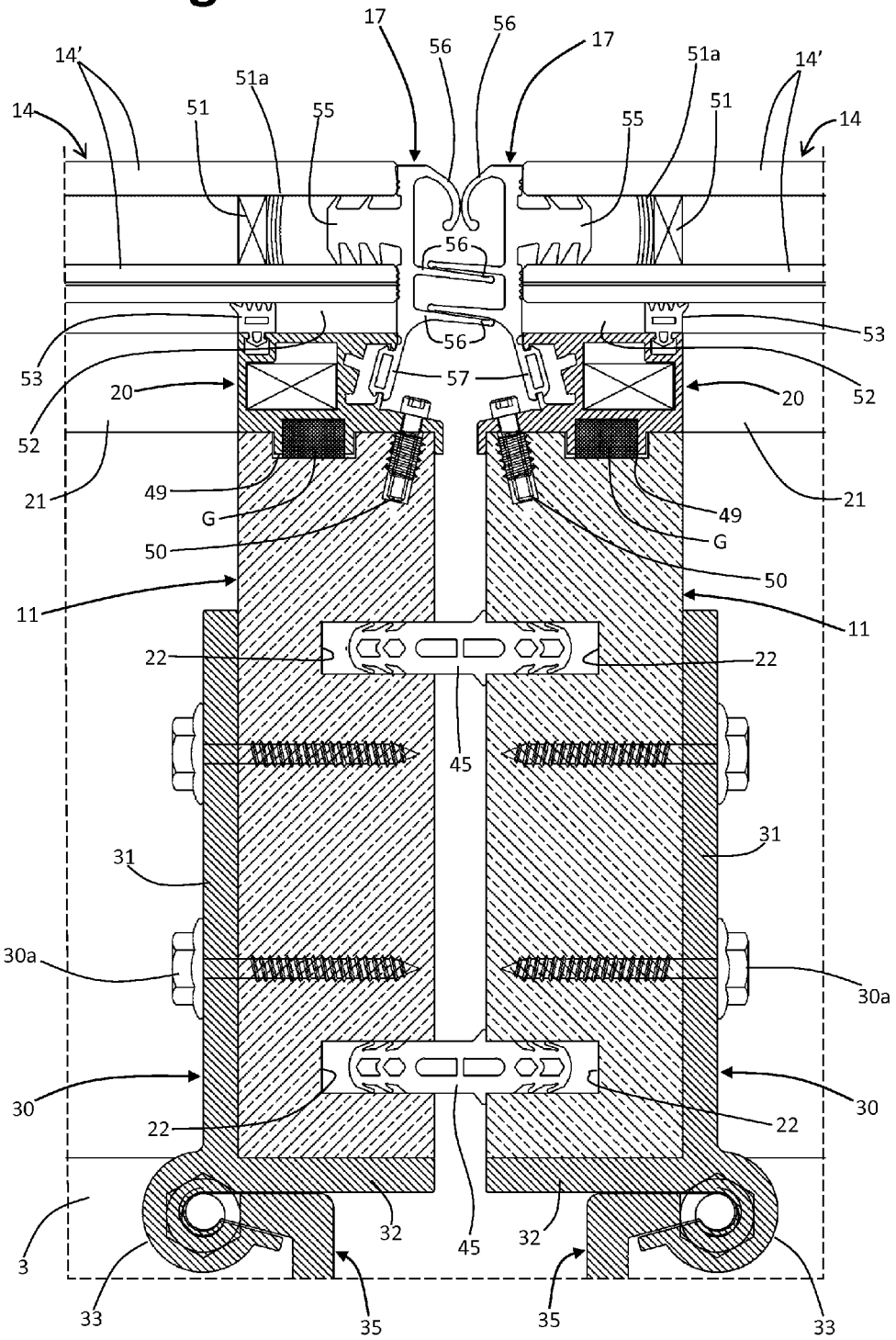

FIG. 13 illustrates the mode of fixing to the corresponding upright 11 of an element 30 of the engagement device 24 of FIGS. 5-6, using the screws 30*a* referred to previously. There are moreover clearly visible two adjacent uprights 11, with the respective grooves 22, engaged in which are the weatherstrips 45. There may moreover be noted the grooves 49 provided at the front of the cross members 12, where respective portions of the interface sectional elements 20 are housed, preferably with interposition of corresponding gaskets G.

In a preferred embodiment, such as the one represented, screws or similar threaded members 50 are provided for securing the interface sectional elements 20, 21 to the front of the uprights and/or of the cross members. As will emerge more clearly hereinafter, it is possible to act on these screws 50 from the front of the cells 2. Moreover clearly visible in FIG. 13 is the structure of the infill elements 14 of the two cells set adjacent in a horizontal direction, with the corresponding pairs of panes of glass 14', set between which are spacer members 51. The panes are fixed together via an adhesive 51*a*. According to a preferred characteristic of the invention, the infill elements are fixed with respect to the corresponding interface sectional elements by means of a structural adhesive, with the metal sectional elements 20, 21 that are in a position behind the infill element. In FIG. 13, the structural adhesive used for fixing the infill elements 14 to the corresponding sectional elements 20, 21 is designated by 52. Also shown in FIG. 13 are spacer gaskets 53, set between the front of the sectional elements 21 and the rear of the innermost pane of glass 14', which also functions as lateral containment for the adhesive 52. From the figure it may moreover be clearly noted how engaged between the two panes of glass 14' is the respective perimetral weatherstrip 17 having a cross section identical to that of the weatherstrips 18 and 19 of FIG. 4. The weatherstrips 17 (or 18 or 19) have a portion 55 that is set between the two panes of glass and a plurality of sealing lips 56, which generally project from the peripheral edge of the panes of glass. As may be noted, the aforesaid lips 56 are designed to co-operate in a sealed way together in the condition where the cells are mounted. Once again, clearly visible in FIG. 13 is a second portion 57 of the weatherstrips 17, which is engaged in a respective housing defined peripherally in the interface sectional elements 20 (and 21). Obviously, FIG. 13 is a cross-sectional view of the sectional elements 20, but the cross section of the sectional elements 21 is similar to the one represented.

As previously mentioned, according to an advantageous characteristic, it is possible to act on the screws 50 used for fixing the sectional elements 20 or 21 from the front of the cells 2. With reference to FIG. 13 it will be appreciated that—also in the assembled condition—it is possible to introduce between the sealing lips 56 of the two adjacent weatherstrips 17 a tool, for example a screwdriver, for removing the screws 50. In this way, in the cells 2 according to the invention, it is possible to separate the interface metal sectional elements 20, 21 from the uprights 11 and the cross members 12 from the front of the cell. This characteristic is particularly advantageous when maintenance operations become necessary, for example for replacement of panes of the infill elements. As has been said, in the embodiment illustrated, the sectional elements 20, 21 are set in a position behind the corresponding infill elements, i.e., completely hidden by the front of the curtain wall.

Figure 14:
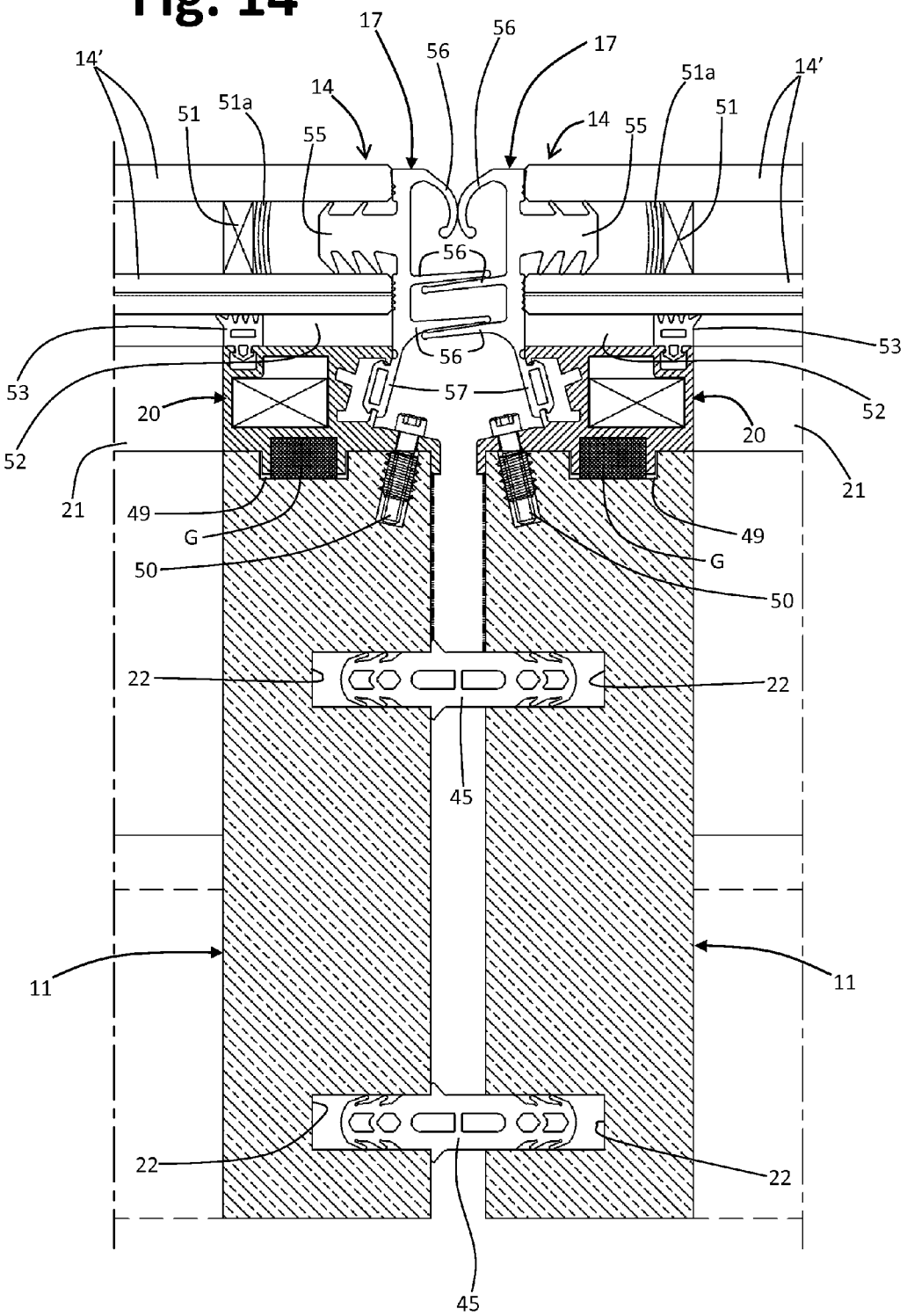

The same elements just described above are visible also in the different cross-sectional view of FIG. 14, where the same reference numbers as those adopted in the previous figures are used to designate technically equivalent elements.

Figure 15:
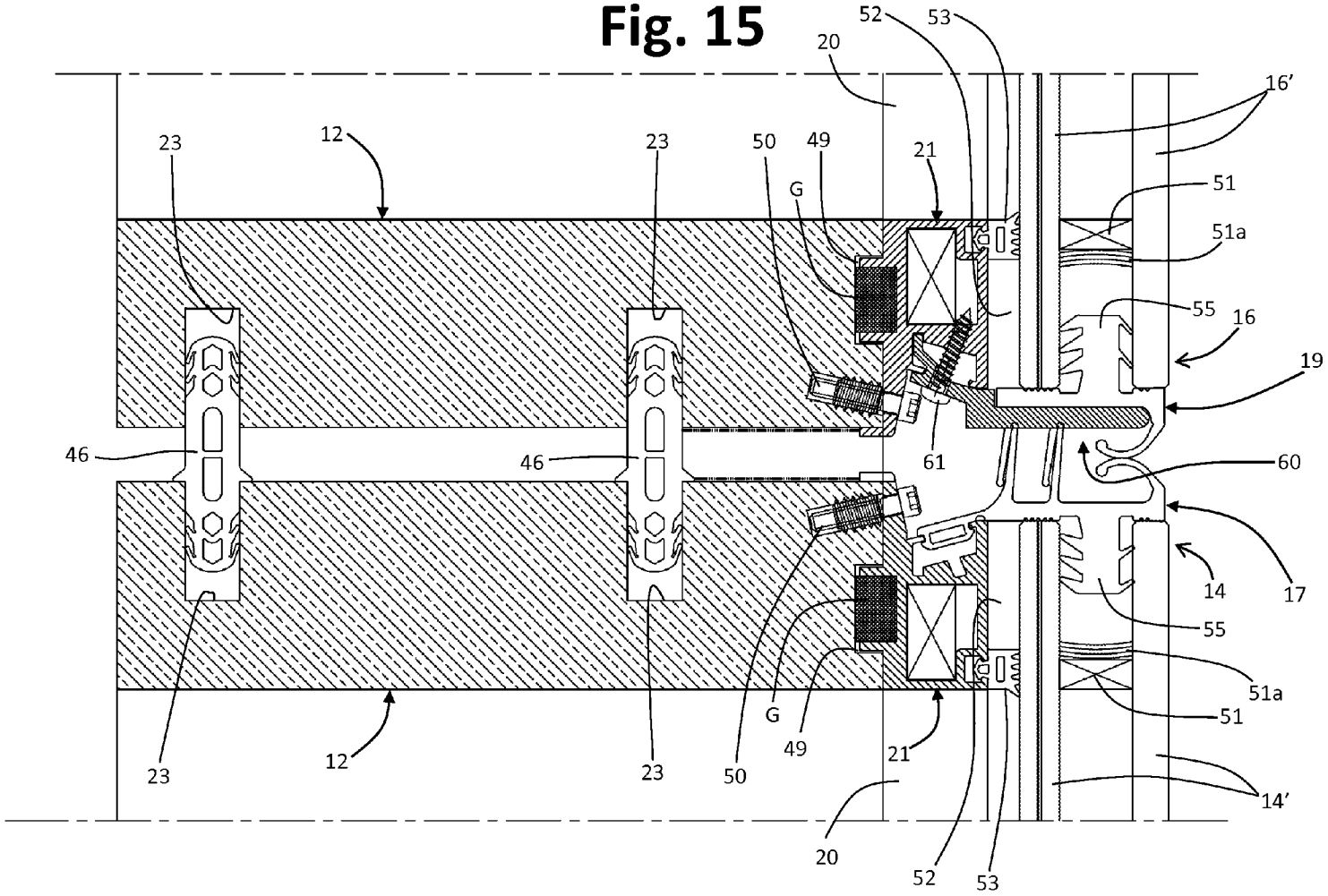

Visible in FIG. 15 are the weatherstrips 46, which have the same cross section as the weatherstrips 45, engaged between the corresponding grooves 23 of adjacent cross members 12. Moreover visible in FIG. 15 is a lower supporting element, designated as a whole by 60, which is designed to support from beneath a respective infill element. One or more of these lower supporting elements 60, made for example of metal material, are anchored via one or more screws 61 to a corresponding interface metal sectional element 21 that is coupled to a cross member 12 of the structural frame of the corresponding cell. The function of the element 60 is precisely that of guaranteeing a higher degree of safety of positioning for the overlying infill element, here infill element 16.

Figure 16:
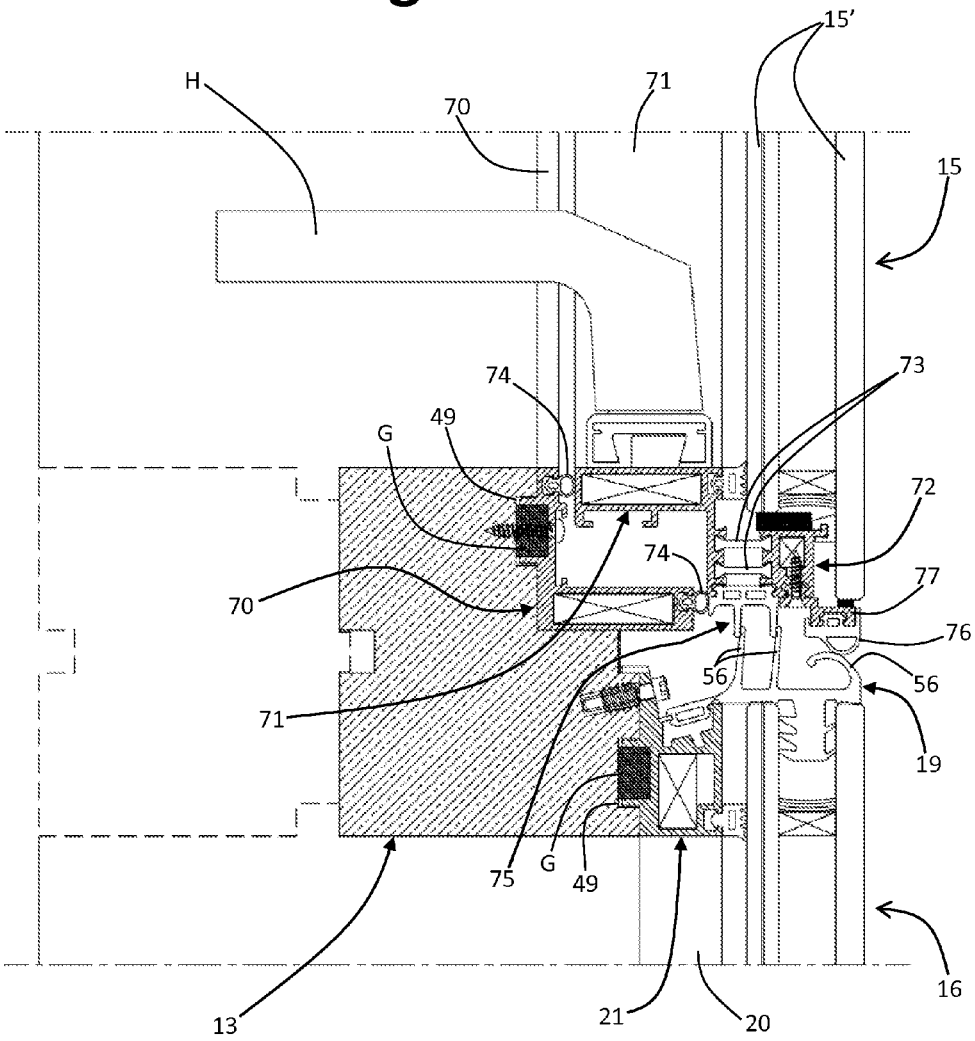
Figure 17:
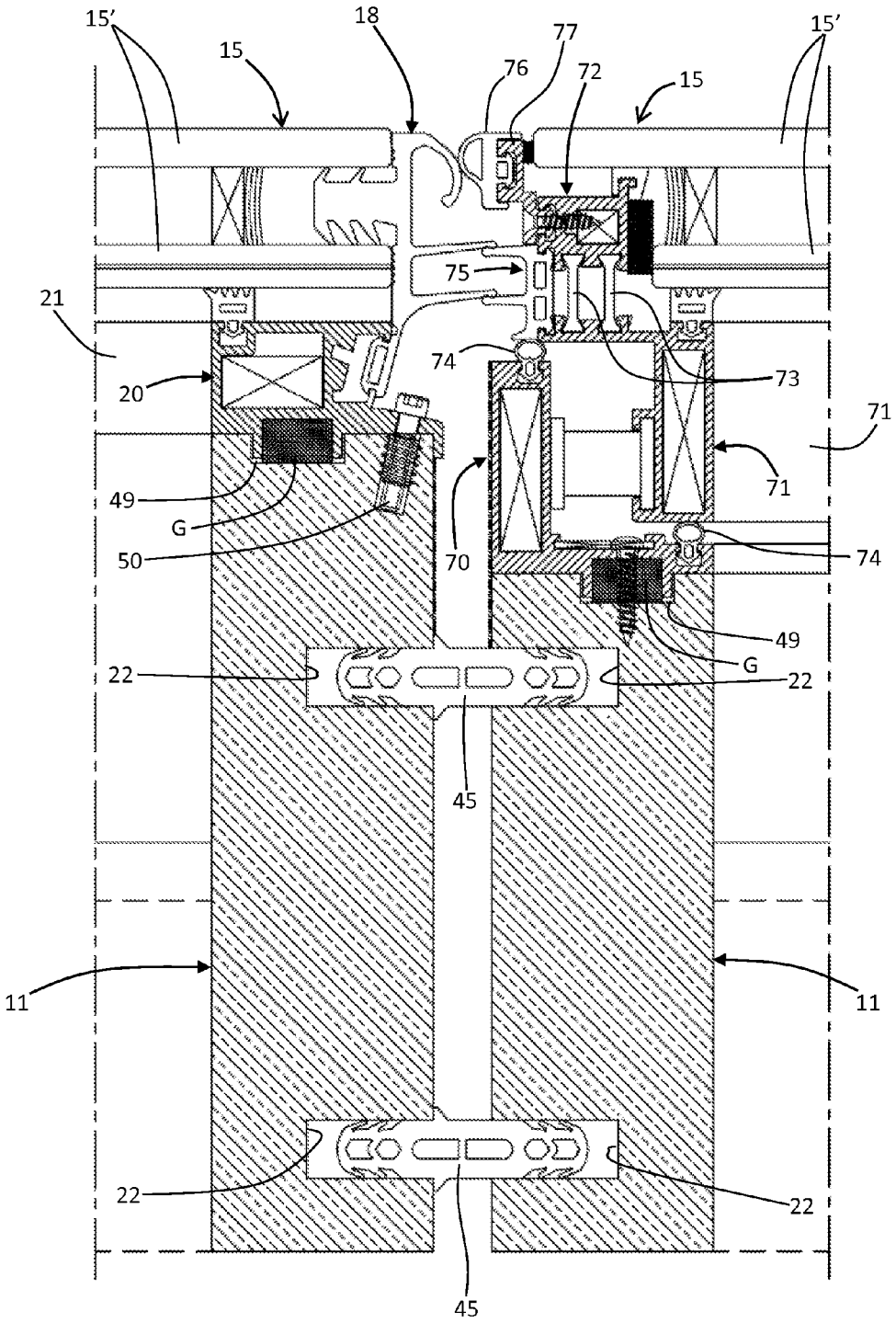

As mentioned previously, one or more of the infill elements that equip a cell according to the invention can be opened like a window. In this case, the openable infill element is coupled to the corresponding uprights and/or to the corresponding cross members via interface sectional elements comprising a fixed sectional element and a sectional element consisting of at least two parts—fixed with respect to one another—that can be displaced together with the infill element in question. With reference to FIGS. 16 and 17, the fixed sectional element, designated by 70, is anchored to the cross member (FIG. 16) or to the upright (FIG. 17), whereas the displaceable sectional element is associated to the openable infill element. In particular, with reference to FIGS. 16 and 17, the displaceable sectional element comprises the two sectional-element parts designated by 71 and 72, which are joined together by means of cut thermal-cut elements 73, for example represented by sectional elements made of plastic material. Operative between the sectional element 70 and the sectional-element part 71 are perimetral weatherstrips, designated by 74. In the case of an openable infill element (the element 15, in the case represented), the corresponding perimetral weatherstrip of FIG. 4 (the weatherstrip designated by 18) is preferentially replaced by a number of weatherstrips. With reference to the example of FIGS. 16-17, coupled between the parts 71 and 72 of the displaceable sectional element is a corresponding first weatherstrip 75, having lips designed to co-operate in a sealed way with respective internal lips of the weatherstrip 19 (FIG. 16) or of the weatherstrip 18 (FIG. 17) of the adjacent cell. Associated to the sectional-element part 72 is a further weatherstrip 76, designed to co-operate with the front sealing lip of the weatherstrip 19 or 18 (FIGS. 16 and 17, respectively). Preferably, the weatherstrip 76 is sustained by corresponding supports 77 fixed to the sectional element 72 via screws and/or couplings, for example snap-in couplings. Moreover visible in FIG. 16 is a handle H for actuation of a device for opening/closing the infill element 15 illustrated, where said device may be of a type in itself known. In an embodiment of this type, the perimetral dimensions of the innermost pane of the openable infill element are preferentially smaller than those of the external pane, in order to enable housing of the sectional-element part 72.

The shape of the fixed and displaceable interface sectional elements used for obtaining the openable infill elements may of course be different from the one represented, according to the need.

In a particularly advantageous embodiment, the uprights 11 and the cross members 12 and/or 13 are machined at the front in order to enable a set-in positioning of the interface sectional elements 70 and/or 71 of openable infill elements. A solution of this sort may be seen, for example in FIG. 16, where it may be noted how a cross member—here a cross member 13—is machined so as to present a front recess, fixed at which is the sectional-element part 71. In the case of FIG. 17, the upright 11 on the right has instead a smaller depth than the upright of the adjacent cell (the upright 11 on the left) in order to enable housing of the sectional element 70. In either case, front machining of cross members and uprights enables housing of the sectional elements 70 and 71 in a generally set-in position, which enables openable infill elements to be obtained flush with surrounding fixed infill elements.

Figure 18:
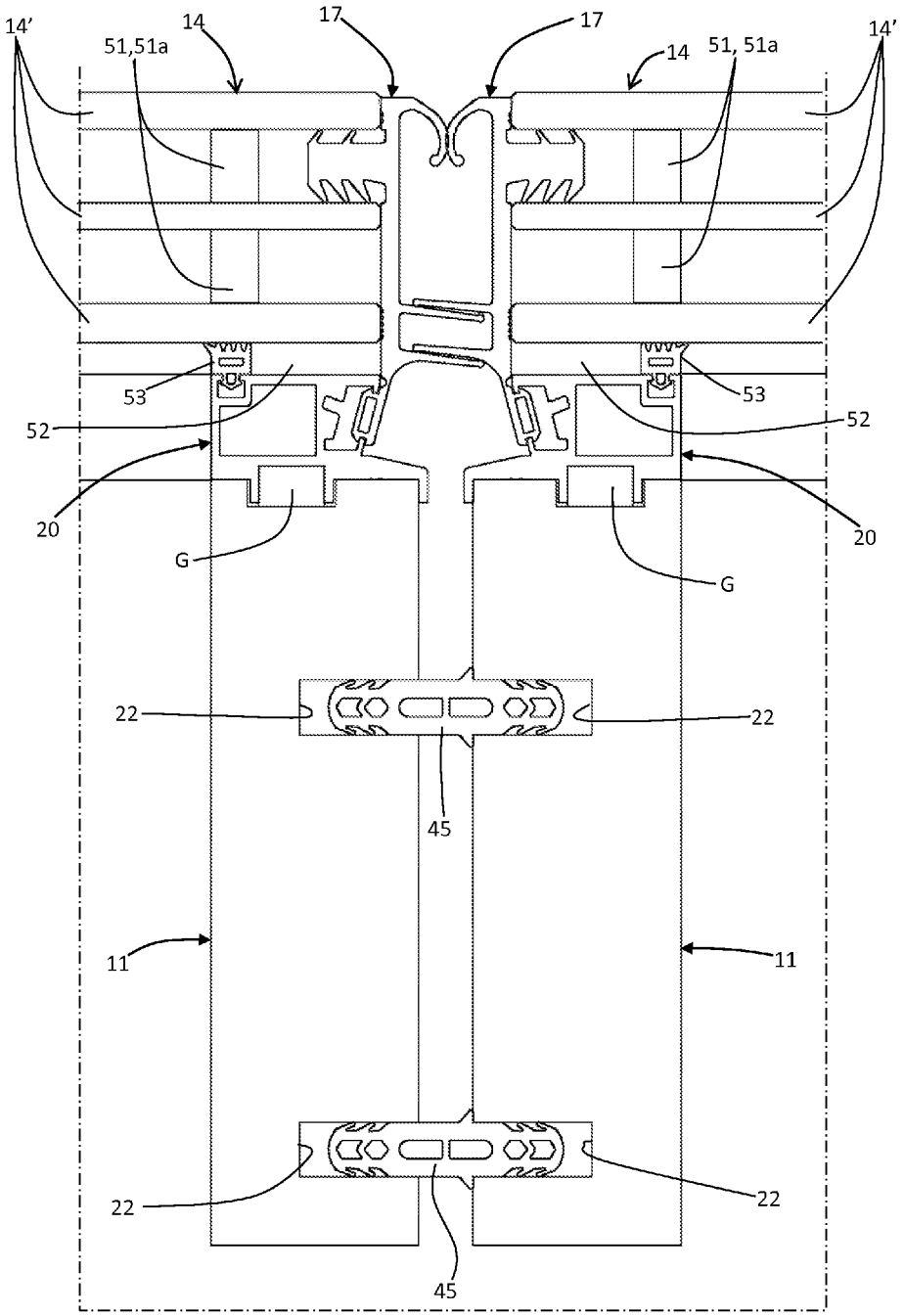
FIG. 18 is a schematic cross section similar to that of FIG. 14, but regarding a variant of the invention.
Figure 19:
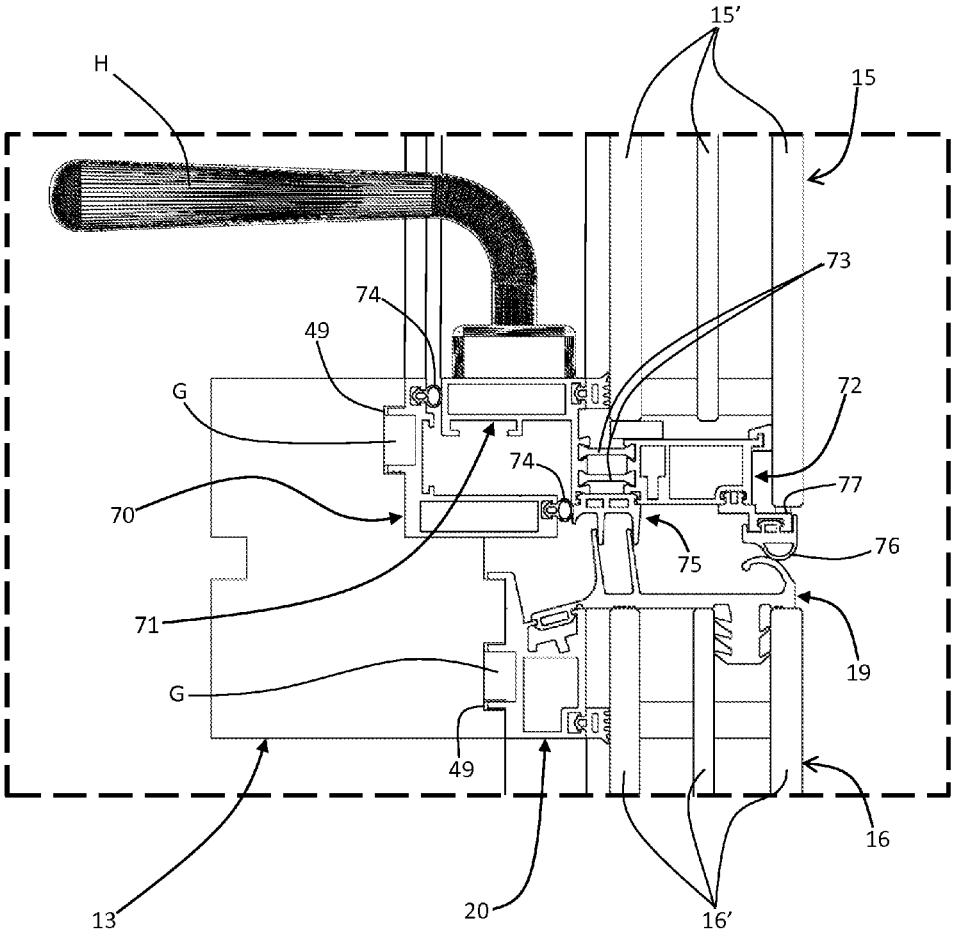
FIG. 19 is a schematic cross section similar to that of FIG. 16, but regarding a variant embodiment of the invention.

FIG. 18 illustrates, in a schematic view similar to that of FIG. 14, a variant embodiment whereby the infill elements represented comprise three panes of glass 14'. As will be appreciated, for the rest, the embodiment is similar to that illustrated in FIG. 14, except for minimal modifications in the shape of the perimetral weatherstrips, which are in any case preferentially distinguished by the presence of a plurality of sealing lips designed to co-operate with those of adjacent cells. FIG. 19 is a view conceptually similar to that of FIG. 16, and is a partial illustration of an openable infill element with corresponding opening/closing handle H. Also in this case, the variant regards the presence of infill elements 15, 16 that comprise three panes 15', 16'.

Figure 20:
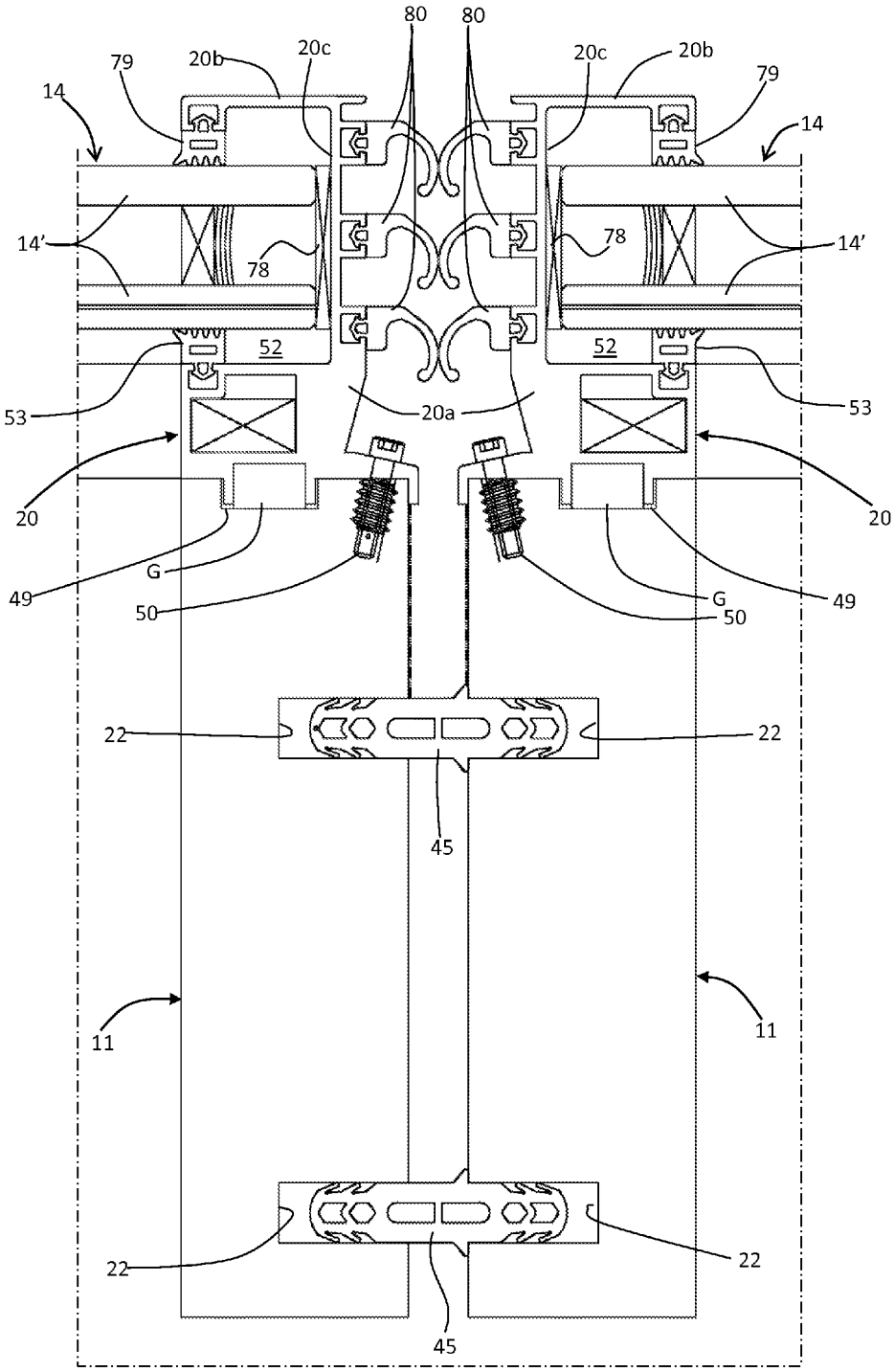
FIGS. 20 and 21 are schematic cross sections similar to those of FIGS. 14 and 18, but regarding as many variant embodiments of the invention.
Figure 21:
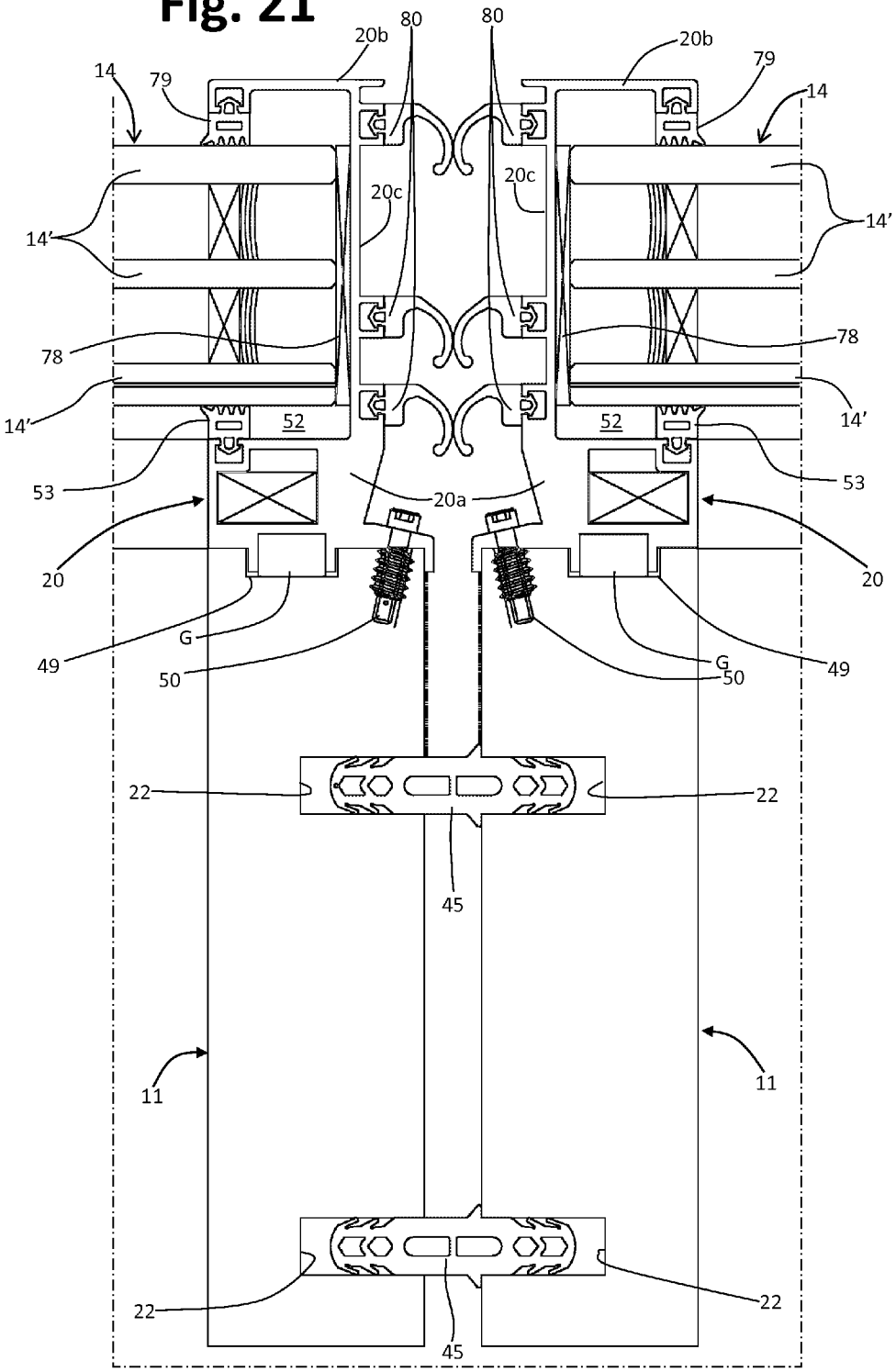

In the embodiments described previously the infill elements 14, 15, and 16 are coupled to the corresponding interface metal sectional elements 20, 21 via a structural adhesive 52, with said interface sectional elements that are in a position behind the infill elements. As has been explained, thanks to this characteristic, from the front of the cells 2 the metal sectional elements are not directly exposed. FIGS. 20 and 21—which are conceptually similar to FIGS. 14 and 18—refer to variant embodiments where the interface metal sectional elements—here the sectional elements 20—are configured so as to support and ensure positioning of the respective infill elements. The interface sectional elements have in this case a base portion 20*a*, fixed to uprights and cross members, and a front portion 20*b*, which are connected together by an intermediate portion 20*c*. Set between the portions 20*a* and 20*b*, generally parallel to one another and perpendicular to the portion 20*c*, are the panes 14' of the infill element 14. In this case, a structural gluing of the infill element 14 to the interface sectional elements 20, 21 is not strictly necessary, even though it is in any case possible. Between the edges of the panes 14' and the inside of the intermediate portion 20*c* of the sectional elements there may be provided an element made of synthetic material 78, for example an element made of rubber or plastic, having the function of preserving the integrity of the panes themselves. A weatherstrip 79 is moreover preferably provided between the front portion 20*b* of the sectional element 20 and the front of the outermost pane 14'.

In such an embodiment, then, visible from the front of the curtain wall 1 are the aforesaid front portions 20*b* of the interface metal sectional elements.

In one embodiment, such as the one exemplified in FIGS. 20 and 21, instead of a single perimetral weatherstrip the interface sectional elements 20 and 21 support a plurality of perimetral weatherstrips 80 in parallel, which basically perform the functions of the individual sealing lips of a single weatherstrip, as in the embodiments described previously. As may be noted, also in this case, the individual perimetral weatherstrips 80 of two adjacent cells are designed to co-operate with one another in the installed condition. It will be appreciated that in this embodiment the weatherstrip or weatherstrips is/are directly supported by the interface metal sectional elements, which are provided for this purpose with respective seats, in particular on the outer side of its intermediate portion 20*c*.

Figure 22:
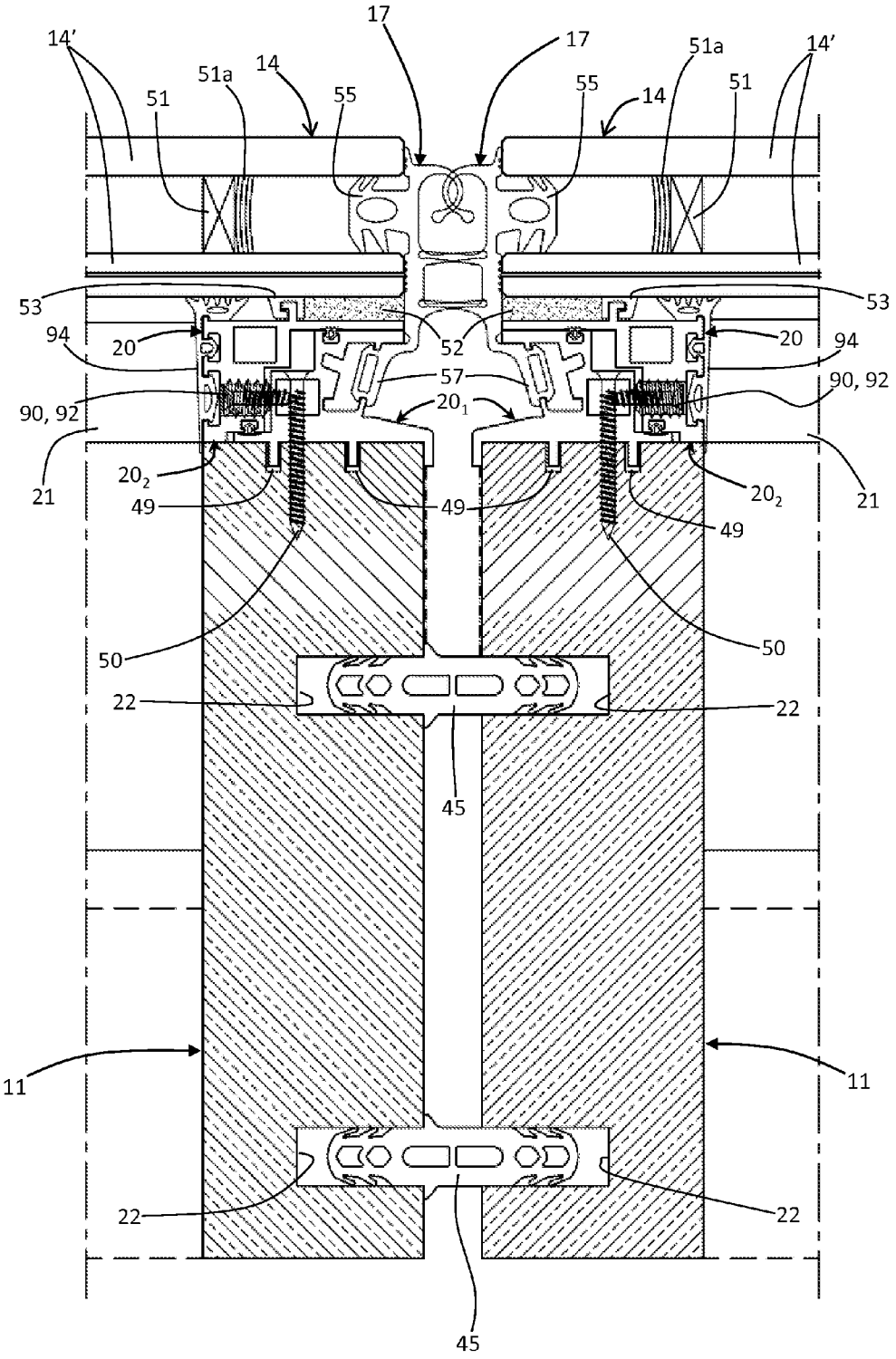
FIG. 22 is a schematic cross section, similar to that of FIG. 14, of a variant embodiment of the invention.
Figure 23:
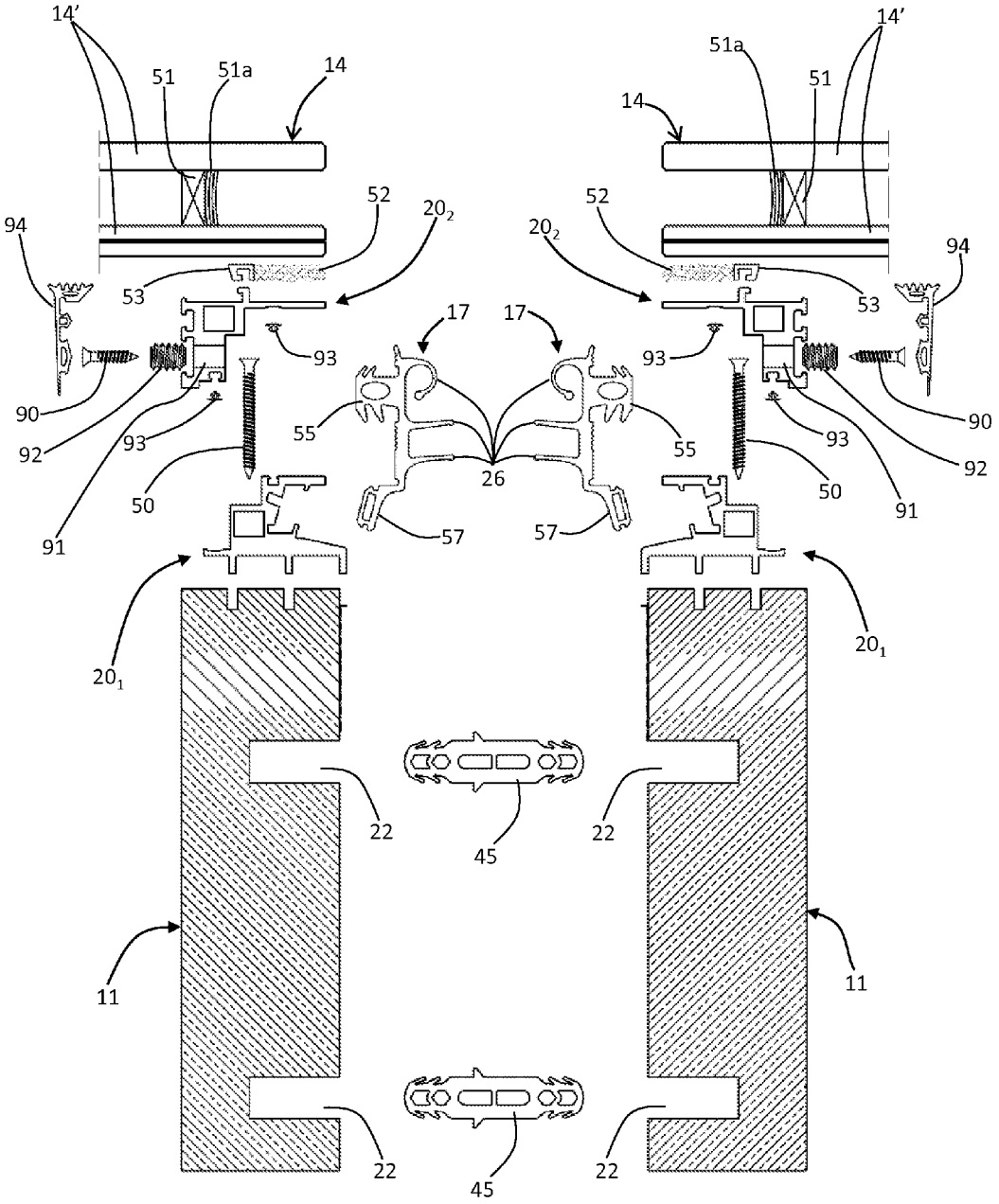
FIG. 23 is a schematic exploded view of the components shown in FIG. 22.

In FIGS. 22 and 23 a further variant embodiment of the invention is illustrated in a schematic form. In FIGS. 22 and 23 the same reference numbers as those adopted in the previous figures are used to designate technically equivalent elements.

In this embodiment the interface sectional elements 20 and 21 are obtained in at least two parts, preferably metal parts. In particular, in FIGS. 22-23 the sectional elements 20 includes the two parts of sectional element designated by $\mathbf{20}_1$ and $\mathbf{20}_2$, secured to each other via threaded members, such as screws. The sectional element parts $\mathbf{20}_1$ are secured via screws 50 or similar threaded members to the front of the uprights 11, at the corresponding grooves 49. To the sectional element parts $\mathbf{20}_1$ are then secured the sectional element parts $\mathbf{20}_2$, to which the corresponding infill element 14 is secured via the corresponding structural adhesive: fixing between the two sectional element parts $\mathbf{20}_1$ and $\mathbf{20}_2$ is obtained via threaded member, such as self-tapping screw, some of which designated by 90.

In the example, the sectional element parts $\mathbf{20}_2$ defines a plurality of through holes or seats 91, spaced form each other in the longitudinal direction, within which corresponding bushings 92 are secured, particularly externally threaded bushings, wherein the screws 90 passes through the bushings 92, up to tighten on the sectional element parts $\mathbf{20}_1$. Also in this construction there are provided housings for the portions 57 of the weatherstrips 17 (or 16 or 18), here defined in the sectional element parts $\mathbf{20}_1$ Preferably further gasket are provided, designated by 93, between the sectional element parts $\mathbf{20}_1$ and $\mathbf{20}_2$, secured in corresponding seats defined in the parts $\mathbf{20}_1$ and $\mathbf{20}_2$. The screws 50 are here positioned in such a way that the corresponding heads are in the interface area between the two sectional element parts $20_1$ and $20_1$.

Preferably the front of the sectional element part $20_2$ defines couplings for the gaskets 53. The sectional element parts $20_2$ preferably also defines housings or couplings for a further side gasket or covering, designated by 94, having substantially an aesthetic function, that is, to hide the side of the sectional element part $20_2$ at which are the heads of corresponding screws 90. In fact it will be appreciated that, in this embodiment, the heads of the screws 90 are at the inner face of the sectional elements 20 (i.e., of their parts $20_2$), which faces towards the compartment V (FIGS. 2-3) delimited by the wooden frame of the cell. The embodiment of FIGS. 22-23 has indeed the great advantage of enabling disassembling of an outer infill element—here an element 14—directly from the inside of the building, in contrast to the embodiments previously described. To this purpose, if need be, it suffices to remove from the inside of the buildings the gaskets or coverings 94 and subsequently unscrew the screws 90, thereby separating the sectional element parts $20_2$—with the associated infill element—from the sectional element parts $20_1$ that remains fixed to the wooden frame.

Clearly, in this embodiment, the construction of the sectional elements 21 is the same as that described with reference to the sectional elements 20 of FIGS. 22 and 23, the only substantial difference being represented by the fact that the two-parts sectional elements 21 will be secured to the cross member 12 and/or 13 of the wooden frame of the cell.

Figure 24:
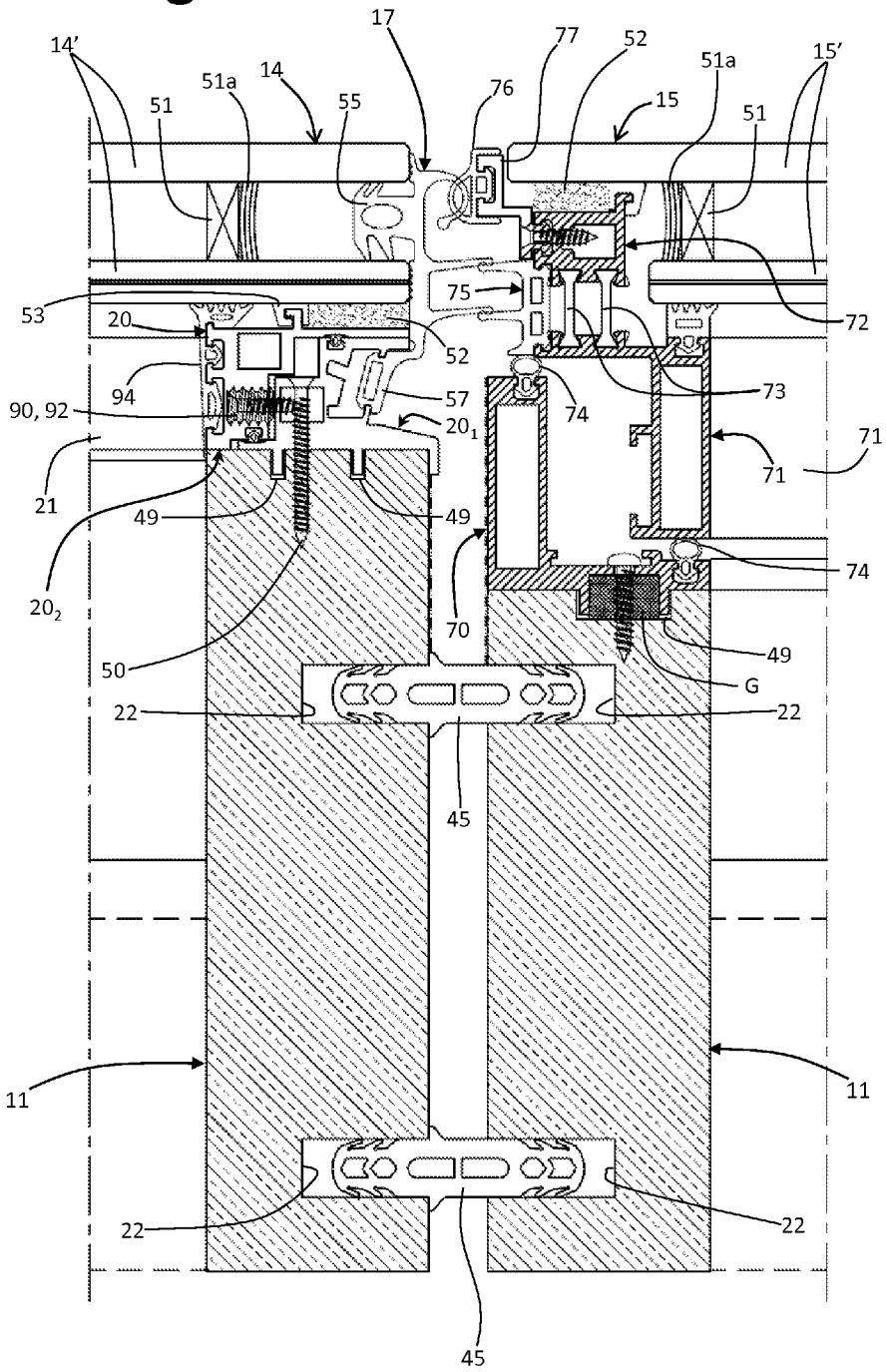
FIG. 24 is a schematic cross section similar to that of FIG. 17, but in accordance with the variant embodiment of FIGS. 22-23.

The embodiment of FIGS. 22-23 is clearly usable also in case of infill elements that can be opened and closed, as shown in FIG. 24, where the same reference numerals as those adopted in FIGS. 17 and 22 are used to designate technically equivalent elements.

Figure 25:
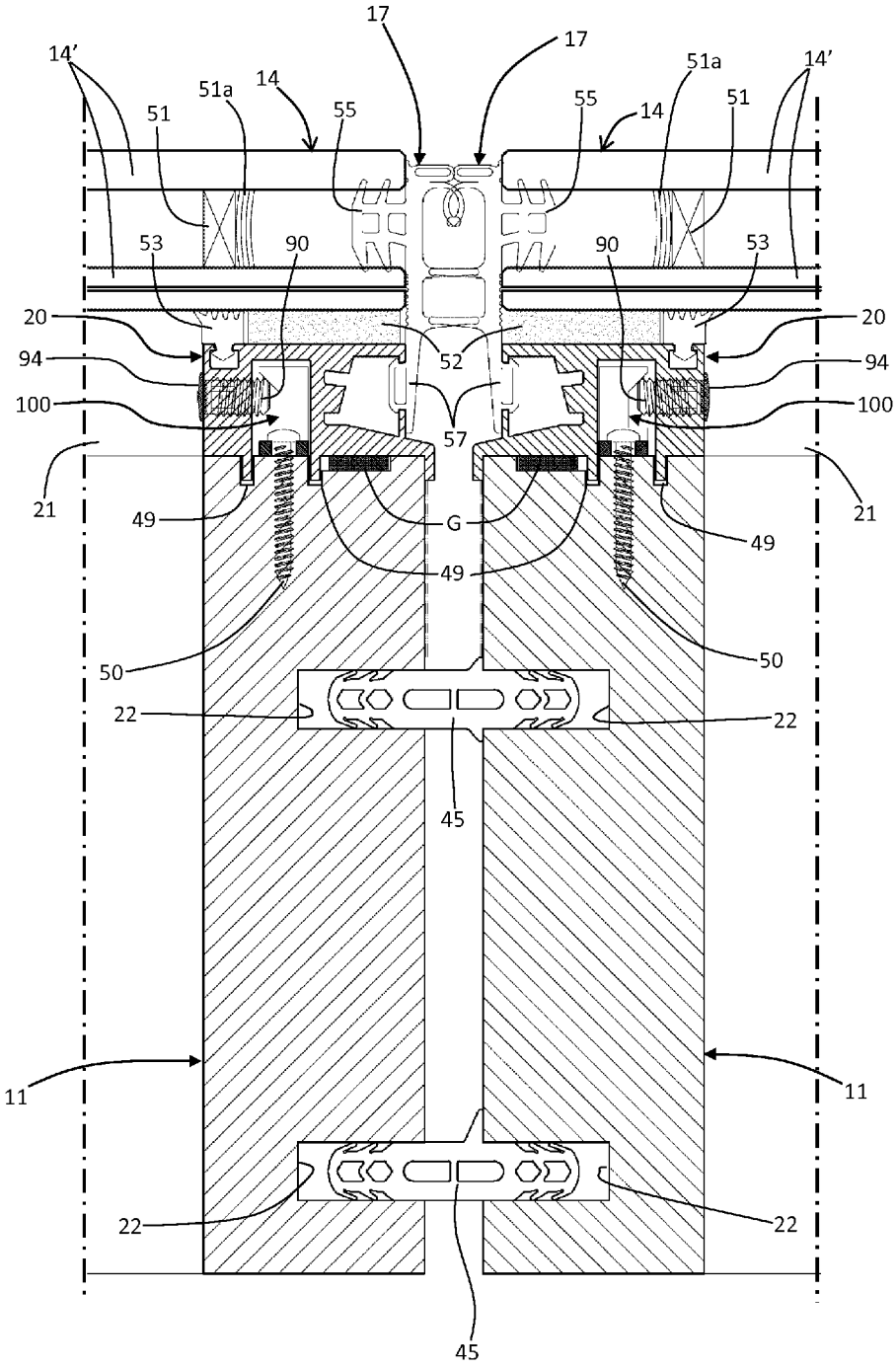
FIGS. 25 and 26 are views similar to those of FIGS. 22 and 23, but relating to a further embodiment of the invention.
Figure 26:
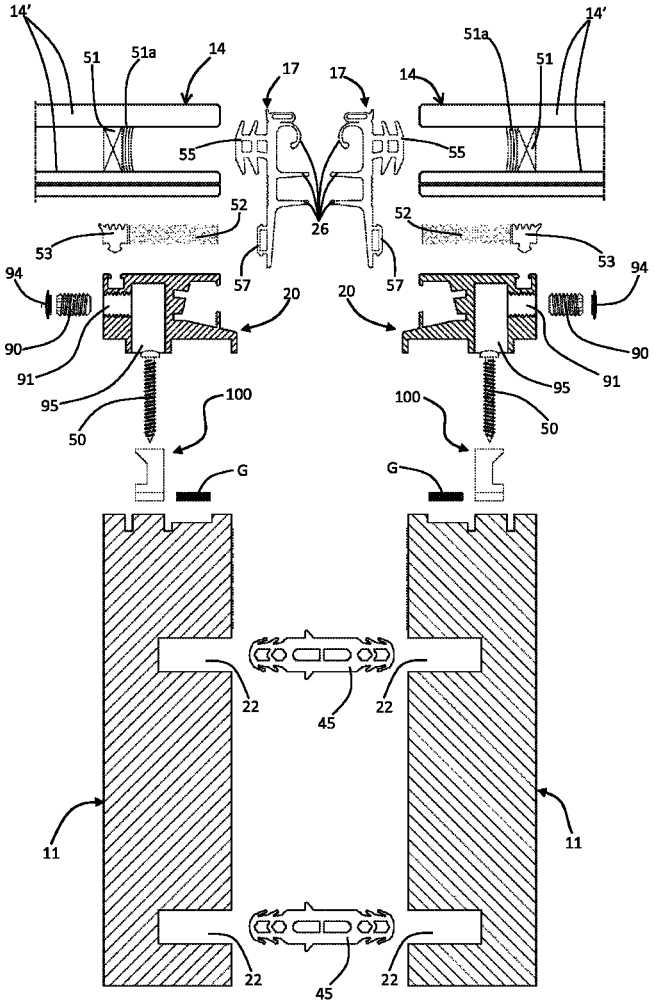

In FIGS. 25 and 26 a further embodiment of the invention is illustrated in a schematic form. In FIGS. 25 and 26 the same reference numbers as those adopted in the previous figures are used to designate technically equivalent elements.

In this embodiment the interface sectional elements 20 and 21 are anchored by means of retention members fixed to uprights and cross members of the wooden frame of the cell.

In particular, as shown in FIG. 26, the sectional elements 20 have, in the back thereof, a longitudinal groove 95, within which at least one retention member 100 is receivable. In an embodiment there are provided to this purpose a plurality of members 100 for the fastening of a respective sectional element 20, which are configured as small blocks that are arranged at a certain distance from each other within the groove 95. In a different embodiment there is instead provided a single retention member 100, configured as a longitudinal sectional element that extends within the groove 95.

Figure 27:
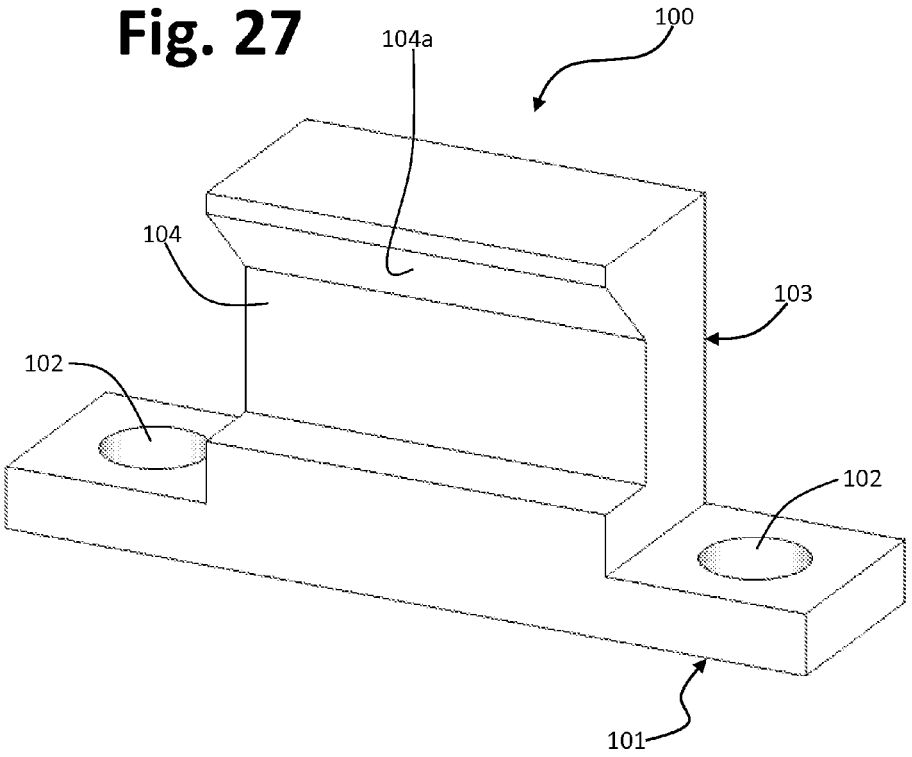
FIGS. 27 and 28 are schematic perspective views of two versions of a member for anchoring sectional elements used in the embodiment of FIGS. 25-26.

In FIG. 27 there is represented a member 100 configured as a small block, preferably made of a metal material, for example steel or aluminum. In the example shown the member 100 has a base 101 provided with fixing holes 102, from which there raises an upright part 103 having at a side thereof a longitudinal recess 104, preferably defining an upper inclined plane 104*a*.

The member 100 are designed to be secured to the front of the uprights 11 by means of first threaded members, and the sectional elements 20 are then secured to the member 100 by means of second threaded members. To this purpose, a plurality of members 100 is fixed to the front of the upright 11 via corresponding screws 50, passing through the holes 102 of the base 101 of the corresponding member 100, with the members 100 mutually aligned and at a certain distance from each other. The member 100 are fixed with the respective recesses 104 oriented in a same direction, preferably towards the inside of the cell.

Turning back to FIG. 26, the sectional elements 20 have a respective plurality of through holes or seats 91, spaced apart from each other, that extend transversally with respect to the groove 95 and that open in the latter. In the seats 91, preferably threaded seats, there can be screwed respective threaded members 90, here represented by threaded dowels. The seats 91 are defined in a side of the sectional element 20 that, in the assembled condition, faces the recess 104 of the retention members 100. Thus, the seats 941 are defined on the sectional elements in position substantially corresponding to the positions of fixing of the members 100 to the uprights.

The sectional elements 20 are fitted on the front of the uprights in such a way that the retention members 100 result to be inserted in the groove 95. With the corresponding recesses 104 facing the seats 91. Also in one such embodiment the sectional element 20 preferably has portions designed to engage in corresponding front groves 49 of the uprights, as well as interposed sealing means G.

Thereafter the threaded dowels are tightened in the relevant seats 91, such that their distal ends engage with the recesses 104 of the corresponding member 100, particularly at the relevant inclined planes 104*a*. In this way, to the uprights 11 there result fastened the sectional elements 20, to which the corresponding infill element 14 is secured via the corresponding structural adhesive 52.

Also in this solutions the sectional elements 20 define seats for the gaskets 53 and for part 57 of the weatherstrips 17. At the dowels 90 covering elements 94 are applied, having basically aesthetic functions, here configured as small plugs. It will appreciated that, also in this embodiment, the head ends of the dowels 90 are at the inner face of the sectional elements 20. With the possibility of disassembling an outer infill element—here element 14—directly from the inside of the building. To this purpose, if need be, it suffices to remove from the inside of the buildings the coverings 94 and subsequently unscrew the dowels 90, thereby separating the sectional element 20—with the associated infill element—from the retention members 100.

Figure 28:
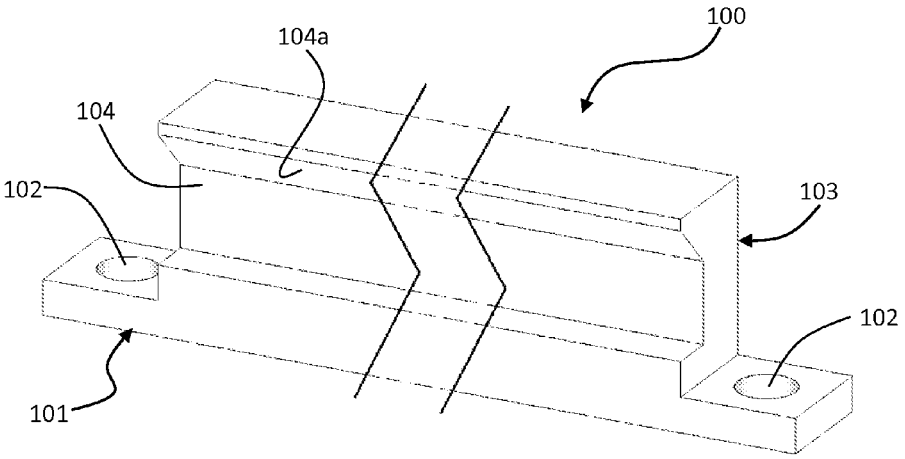

As mentioned, in a possible embodiment, to the front of the uprights there can be fastened a single member 100 configured as a longitudinally extended sectional element, rather than a plurality of block-like members 100 spaced from one another. FIG. 28 just shows, in a schematic way, the case of a member 100 shaped as a longitudinal sectional element: as can be seen, the sectional element of FIG. 28 includes the same functional parts of the block-like member of FIG. 27.

Figure 29:
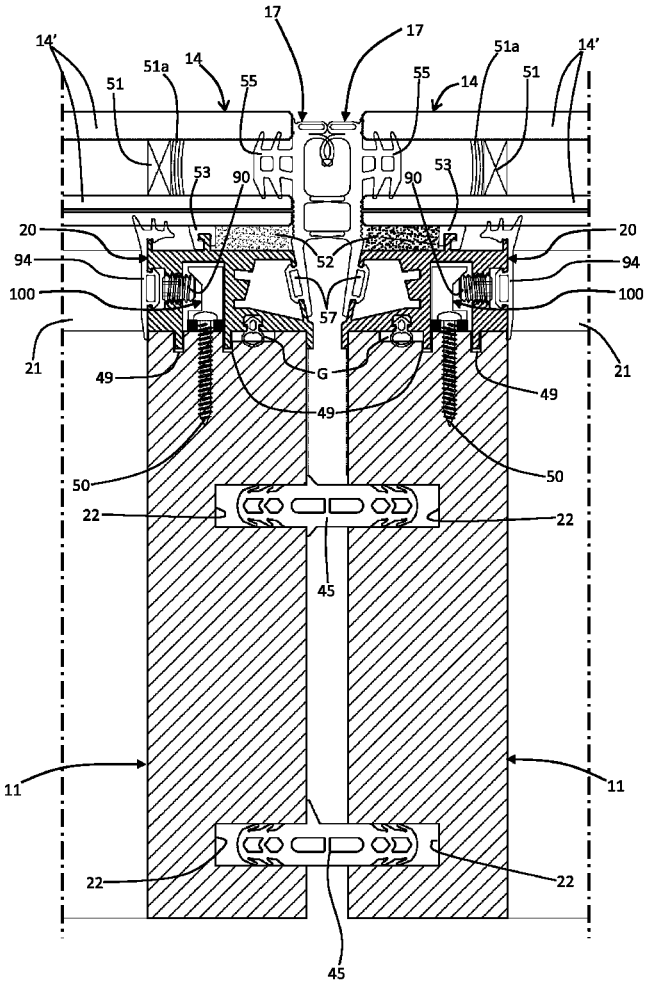
FIGS. 29 and 30 are views similar to those of FIGS. 25 and 26, but relating to a further embodiment of the invention.
Figure 30:
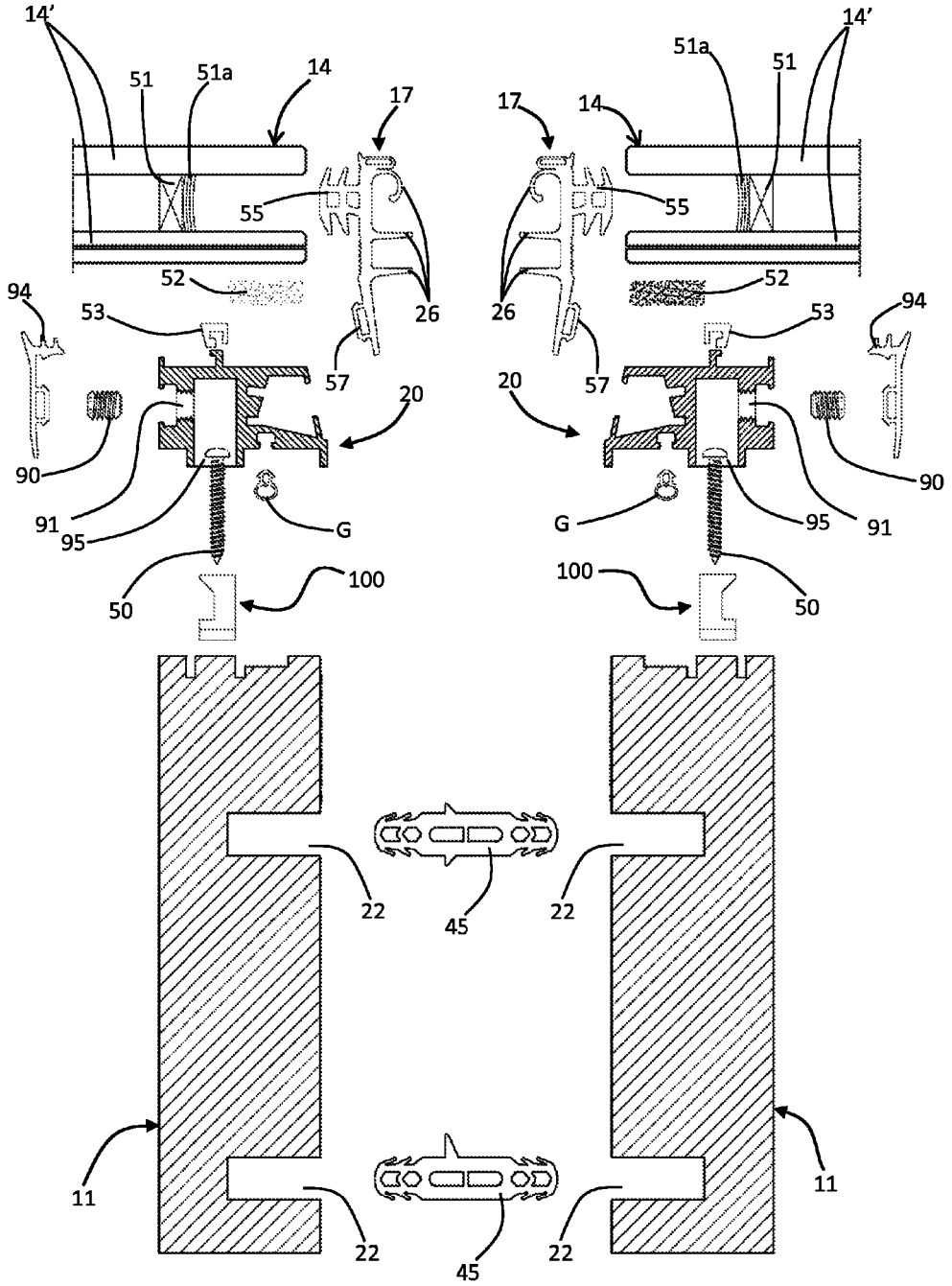

FIGS. 29 and 30 show, with views similar to those of FIGS. 25 and 26, a further embodiment, that differs from the preceding one substantially in that, in this case, the means to hide the heads of the dowels 90 are embodied, rather than by plugs, by a lateral gasket or covering 94, similar to the one shown in FIGS. 22-23. The shape of the sectional elements 20 is also slightly modified at the housing area of the portion 57 of the weatherstrips 17, as well as for a different type of gasket G.

Clearly, also in the embodiments of FIGS. 25-26 and 29-30, the construction of the sectional elements 21 is the same as that described with reference to the sectional elements 20 of the cited figures, the only substantial difference being represented by the fact that the retention member 100 for the sectional elements 21 21 will be secured to the cross member 12 and/or 13 of the wooden frame of the cell. The embodiments of The embodiment of Figures of FIGS. 25-26 and 29-30 are 22-23 are clearly usable also in case of infill elements that can be opened and closed.

From the foregoing description, the characteristics and advantages of the present invention emerge clearly, principally represented by the simplicity of construction of the cells provided (which may be easily prefabricated on a production site), their ease of assembly on the load-bearing structure of a building, and the excellent characteristics of thermal and acoustic insulation, as well as the increased fire resistance. Not the least significant advantage of the solution proposed is the improved aesthetic appearance, due to the fact that the structural frame of the cells is constituted by uprights and cross members made of wood, directly in view from inside the building.

Obviously, the concepts illustrated and described in relation to some elements of a cell—such as the interface sectional elements or the infill elements—can be applied also to other similar elements of the same cell not represented in the figures.

The invention claimed is:

1. A curtain-wall system for a building, comprising a plurality of prefabricated cells, wherein each cell includes:

a structural frame with at least two uprights and two end cross members, coupled together to form a perimetral structure that delimits a compartment;

one or more infill elements associated to the structural frame at a front thereof, for closing the compartment delimited by the perimetral structure; and interface sectional elements for coupling the one or more infill elements to the front of the structural frame, wherein the uprights and the cross members of the structural frame are wooden uprights and cross members, the wooden uprights having at least one first longitudinal groove on a corresponding outer face and the wooden cross members having at least one second longitudinal groove on a corresponding outer face, wherein the structural frame is pre-arranged in such a way that a number of cells are set aligned with one another in at least one direction between a horizontal direction, at respective adjacent wooden uprights, and a vertical direction, at respective adjacent wooden cross members, wherein between the first grooves of adjacent wooden uprights of two cells set aligned with one another in a horizontal direction a first weatherstrip is housed and in the second groove of a wooden cross member of each cell a second weatherstrip is at least partially housed, wherein the wooden uprights have, at a first end, a respective coupling member having an engagement portion that projects axially from the structural frame and has, at a second end, a receiving seat substantially having a shape corresponding to that of the engagement portion of the coupling member, in such a way that the engagement portions of the coupling members at the first end of the wooden uprights of a first cell are received in the receiving seats at the second ends of the wooden uprights of a second cell that is aligned in a vertical direction on top of the first cell.

2. The system according to claim 1, wherein the second weatherstrip is housed between the second grooves of adjacent wooden cross members of two cells set aligned with one another in a vertical direction.

3. The system according to claim 1, wherein the second weatherstrip has a length greater than the length of the wooden cross members of the structural frame, in such a way that the second weatherstrip extends in the second grooves of wooden cross members of two or more cells set aligned with one another in a horizontal direction.

4. The system according to claim 3, wherein the wooden uprights have longitudinal end faces that have at least one third groove, the at least one third groove being axially aligned with the second groove of a wooden cross member, the second weatherstrip extending also through the third groove.

5. The system according to claim 1, further comprising a suspension member designed for fixing to a floor of the building, wherein the wooden uprights have, in a respective upper end region, an engagement device pre-arranged for coupling with said suspension member.

6. The system according to claim 5, wherein at least one of the engagement device and the suspension member has an adjustment element, which is operable for height adjustment of a position of the cell relative to the floor to which the suspension member is fixed.

7. The system according to claim 5, wherein the engagement device is fixed to an inner face of a corresponding wooden upright of the structural frame.

8. The system according to claim 1, wherein the wooden uprights have at least two first parallel grooves for respective first weatherstrips and the wooden cross members have at least two second parallel grooves for respective second weatherstrips, the two first parallel grooves being spaced apart from one another by a spacing distance and the two second parallel grooves being spaced apart from each other by a spacing distance, the spacing distance between the two first parallel grooves being substantially the same as the spacing distance between the two second parallel grooves.

9. The system according to claim 1, wherein the wooden uprights have at least two first parallel grooves for respective first weatherstrips and the wooden cross members have at least two second parallel grooves for respective second weatherstrips, and wherein the distance between the first grooves and the distance between the second grooves are greater than a dimension of width of one said coupling member or of the corresponding engagement portion.

10. The system according to claim 1, wherein the wooden uprights and the wooden cross members of the structural frame have at least one front longitudinal groove, for coupling of a corresponding portion of a respective interface sectional element.

11. The system according to claim 1, further comprising threaded members for securing the interface sectional elements to a front of the wooden uprights and of the wooden cross members, the threaded members being operable from a front of the cell.

12. The system according to claim 1, wherein the interface sectional elements each comprise at least two sectional elements parts secured to each other and wherein a first sectional element part is secured by means of first threaded members to a front of a corresponding wooden upright or of a corresponding wooden cross member, and a second sectional element part, to which a corresponding infill element is secured, is fastened by means of second threaded members to the first sectional element part, the second threaded members being operable from an inner side of the cell.

13. The system according to claim 1, wherein the interface sectional elements have a back with a longitudinal groove and a side with a plurality of through seats that extend transverse to the longitudinal groove and open thereinto, wherein in the longitudinal grooves there extend at least partially one or more retention members secured by means of first threaded members to a front of a corresponding wooden upright or of a corresponding wooded cross member, the retention member or members having a longitudinal recess facing the through seats of the corresponding interface sectional elements, and wherein the interface sectional elements are fixed to the retention member or members by means of second threaded members tightened in the through seats to engage the longitudinal recess of the retention member or members.

14. The system according to claim 1, wherein at least one first infill element is set between a base portion and a generally parallel front portion of corresponding interface sectional elements.

15. The system according to claim 1, wherein the wooden cross members comprise a lower cross member, to which a corresponding lower interface sectional element is fixed, to the latter there being fixed at least one lower supporting element for one said infill element, the lower supporting element projecting at the front with respect to the lower interface sectional element.

16. A curtain-wall system for a building, comprising a plurality of prefabricated cells, wherein each cell includes:

a structural frame with at least two uprights and two end cross members, coupled together to form a perimetral structure that delimits a compartment;

one or more infill elements associated to the structural frame at a front thereof, for closing the compartment delimited by the perimetral structure; and interface sectional elements for coupling the one or more infill elements to the front of the structural frame, wherein the uprights and the cross members of the structural frame are wooden uprights and cross members, the wooden uprights having at least one first longitudinal groove on a corresponding outer face and the wooden cross members having at least one second longitudinal groove on a corresponding outer face, wherein the structural frame is pre-arranged in such a way that a number of cells are set aligned with one another in at least one direction between a horizontal direction, at respective adjacent wooden uprights, and a vertical direction, at respective adjacent wooden cross members, wherein between the first grooves of adjacent wooden uprights of two cells set aligned with one another in a horizontal direction a first weatherstrip is housed and in the second groove of a wooden cross member of each cell a second weatherstrip is at least partially housed, wherein the infill elements include at least one first infill element that comprises at least two panel elements set parallel to one another, and wherein at least one of the infill elements are fixed to corresponding interface sectional elements by means of a structural adhesive, the interface sectional elements being in a position where they are set behind the corresponding infill element, and engaged between two panel elements of the at least one first infill element is a perimetral weatherstrip, the perimetral weatherstrip having a plurality of sealing lips projecting laterally with respect to a peripheral edge of the panel elements, the sealing lips of the perimetral weatherstrip of a first cell being designed to co-operate in a sealed way with the sealing lips of the perimetral weatherstrip of a second cell, which is set aligned, in a horizontal direction or in a vertical direction, with the first cell.

17. The system according to claim 16, wherein the perimetral weatherstrip is moreover engaged to the interface sectional elements of the at least one first infill element.

18. A curtain-wall system for a building, comprising a plurality of prefabricated cells, wherein each cell includes:

a structural frame with at least two uprights and two end cross members, coupled together to form a perimetral structure that delimits a compartment;

one or more infill elements associated to the structural frame at a front thereof, for closing the compartment delimited by the perimetral structure; and interface sectional elements for coupling the one or more infill elements to the front of the structural frame, wherein the uprights and the cross members of the structural frame are wooden uprights and cross members, the wooden uprights having at least one first longitudinal groove on a corresponding outer face and the wooden cross members having at least one second longitudinal groove on a corresponding outer face, wherein the structural frame is pre-arranged in such a way that a number of cells are set aligned with one another in at least one direction between a horizontal direction, at respective adjacent wooden uprights, and a vertical direction, at respective adjacent wooden cross members, wherein between the first grooves of adjacent wooden uprights of two cells set aligned with one another in a horizontal direction a first weatherstrip is housed and in the second groove of a wooden cross member of each cell a second weatherstrip is at least partially housed, and wherein:

at least one infill element is an openable infill element; and the openable infill element is coupled to corresponding wooden uprights and wooden cross members of the structural frame via interface sectional elements that comprise fixed sectional elements and displaceable sectional elements.

19. The system according to claim 18, wherein at least one of the displaceable sectional elements each include at least two sectional element parts coupled together by means of one or more thermal-cut elements, the openable infill element has at least one perimetral weatherstrip supported between the two sectional element parts of corresponding displaceable sectional elements, and the wooden uprights and wooden cross members of the structural frame are machined at the front for fixing at least the aforesaid fixed sectional elements in a set-in position.

20. A prefabricated cells for a curtain-wall system for a building, the cell including:

a structural frame with at least two uprights and two end cross members, coupled together to form a perimetral structure that delimits a compartment;

one or more infill elements associated to the structural frame at a front thereof, for closing the compartment delimited by the perimetral structure; and interface sectional elements for coupling the one or more infill elements to the front of the structural frame, wherein the uprights and the cross members of the structural frame are wooden uprights and cross members, the wooden uprights having at least one first longitudinal groove on a corresponding outer face and the wooden cross members having at least one second longitudinal groove on a corresponding outer face, wherein in the at least one first groove is receivable part of a first weatherstrip and in the at least one second groove is receivable part of a second weatherstrip, wherein the second weatherstrip has a length greater than the length of the wooden cross members of the structural frame, in such a way that the second weatherstrip can extends in the second grooves of wooden cross members of two or more cells set aligned with one another in a horizontal direction, wherein the wooden uprights have longitudinal end faces that have at least one third groove, the at least one third groove being axially aligned with the second groove of a wooden cross member, the second weatherstrip extending also through the third groove, and wherein the wooden uprights and the wooden cross members of the structural frame have at least one front longitudinal groove, for coupling of a corresponding portion of a respective interface sectional element, wherein the wooden uprights have, at a first end, a respective coupling member having an engagement portion that projects axially from the structural frame and has, at a second end, a receiving seat substantially having a shape corresponding to that of the engagement portion of the coupling member, in such a way that the engagement portions of the coupling members at the first end of the wooden uprights of a first cell are received in the receiving seats at the second ends of the wooden uprights of a second cell that is aligned in a vertical direction on top of the first cell.

* * * * *